US007630896B2

(12) United States Patent
Tamura et al.

(10) Patent No.: US 7,630,896 B2
(45) Date of Patent: Dec. 8, 2009

(54) SPEECH SYNTHESIS SYSTEM AND METHOD

(75) Inventors: Masatsune Tamura, Kanagawa (JP); Gou Hirabayashi, Kanagawa (JP); Takehiko Kagoshima, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 511 days.

(21) Appl. No.: 11/233,092

(22) Filed: Sep. 23, 2005

(65) Prior Publication Data

US 2006/0224391 A1 Oct. 5, 2006

(30) Foreign Application Priority Data

Mar. 29, 2005 (JP) ..... 2005-096526

(51) Int. Cl.
*G10L 13/06* (2006.01)

(52) U.S. Cl. ..... 704/258; 704/268

(58) Field of Classification Search ..... 704/260, 704/268, 258

See application file for complete search history.

(56) References Cited

U.S. PATENT DOCUMENTS 5,220,629 A * 6/1993 Kosaka et al. ..... 704/260

FOREIGN PATENT DOCUMENTS

JP 2001-282276 10/2001
JP 3368948 11/2002
JP 2003-271172 9/2003

OTHER PUBLICATIONS

"Scalable Concatenative Speech Synthesis Based on the Plural Unit Selection and Fusion Method", Tamura et al, Acoustics, Speech, and Signal Processing, 2005. Proceedings. (ICASSP '05). IEEE International Conference on, vol. 1, Mar. 18-23, 2005 pp. 361-364.*

Ryuya Mizutani, et al., "Speech Synthesis by Plural Unit Selection and Fusion Method", Proceedings of 2004 Springtime Meeting for Reading Research Papers of Acoustical Society of Japan—I -, Acoustical Society of Japan, Mar. 17, 2004, pp. 217-218 (with English translation).

* cited by examiner

*Primary Examiner*—Angela A Armstrong
(74) *Attorney, Agent, or Firm*—Oblon, Spivak, McClelland, Maier & Neustadt, L.L.P.

(57) ABSTRACT

A speech synthesis system in a preferred embodiment includes a speech unit storage section, a phonetic environment storage section, a phonetic sequence/prosodic information input section, a plural-speech-unit selection section, a fused-speech-unit sequence generation section, and a fused-speech-unit modification/concatenation section. By fusing a plurality of selected speech units in the fused speech unit sequence generation section, a fused speech unit is generated. In the fused speech unit sequence generation section, the average power information is calculated for a plurality of selected M speech units, N speech units are fused together, and the power information of the fused speech unit is so corrected as to be equalized with the average power information of the M speech units.

13 Claims, 23 Drawing Sheets

| SPEECH UNIT NUMBER | SPEECH UNIT WAVEFORM |
|---|---|
| 0 |  |
| 1 |  |
| 2 |  |
| ⋮ | ⋮ |

FIG. 4

| SPEECH UNIT NUMBER | PHONEMIC STRUCTURE (SPEECH UNIT NAME) | FUNDAMENTAL FREQUENCY (Hz) | PHONETIC DURATION (msec) | CONCATENATION BOUNDARY CEPSTRUM |
|---|---|---|---|---|
| 0 | /a/ | 308.6 | 74.0 | $c_0(1), c_0(T)$ |
| 1 | /a/ | 300.5 | 65.4 | $c_1(1), c_1(T)$ |
| 2 | /i/ | 334.6 | 69.5 | $c_2(1), c_2(T)$ |
| : | : | : | : | : |

FIG. 9

| ORDER | POWER $P_i$ |
|---|---|
| 1 | 2859883 |
| 2 | 1123152 |
| 3 | 4091979 |
| 4 | 1976278 |
| 5 | 861664 |
| 6 | 1719631 |
| 7 | 2906079 |
| 8 | 1504179 |
| 9 | 690427 |
| 10 | 1420380 |
| 11 | 1615761 |
| 12 | 1597616 |
| 13 | 468091 |
| 14 | 1013498 |
| 15 | 857640 |

$P_f = 2691671$ $r = \sqrt{\frac{P_{ave}}{P_f}} = 0.78$ $P_{ave} = 1647083$

NO POWER CRRECTION

WITH POWER CRRECTION

FUSED-SPEECH-UNIT GENERATION SECTION 25

SPEECH SYNTHESIS SYSTEM AND METHOD

CROSS-REFERENCE TO RELATED APPLICATIONS

This application is based upon and claims the benefit of priority from the prior Japanese Patent Application No. 2005-96526, filed on 29 Mar. 2005; the entire contents of which are incorporated herein by reference.

TECHNICAL FIELD

The present invention relates to speech synthesis systems and methods for text to speech synthesis and, more specifically, to a speech synthesis system and method for generating speech signals from phonetic sequences, and prosodic information including fundamental frequency, phonetic duration, and others.

BACKGROUND OF THE INVENTION

Artificially creating speech signals from any arbitrary text is called "text to speech synthesis". Such text to speech synthesis is generally achieved in three stages of a language processing section, a prosodic processing section, and a speech synthesis section.

An incoming text is first input to the language processing section for morphological analysis, syntactic analysis, or others. The resulting text is then forwarded to the prosodic processing section for processing of accent or intonation, and phonetic sequence/prosodic information, e.g., fundamental frequency, phonetic duration, and others, is output therefrom. Then in the speech synthesis section, the phonetic sequence/prosodic information is used to generate speech waveforms.

One speech synthesis method is of unit selection type, selecting a specific speech unit sequence from a large number of speech units for speech synthesis with any provided phonetic sequence/prosodic information set as a target. With such speech synthesis of unit selection type, any provided phonetic sequence/prosodic information is used as a target for unit selection from a large number of previously-stored speech units. As one technique of unit selection, distortion observed in the resulting synthesized speech caused in the speech synthesis process is defined by level as a cost function, and selection of unit sequence is so performed as to reduce the cost. For example, distortions are converted into numbers as costs, and based on these costs, a speech unit sequence is selected for the use of speech synthesis. Here, the distortions include a target distortion representing a difference observed between a target speech and the candidate speech unit in terms of prosodic/phoneme environment or others, and a concatenation distortion caused by concatenating the consecutive speech units. Thus selected speech unit sequence is used to generate synthesized speech. As such, with such speech synthesis of unit selection type, selecting any appropriate speech unit sequence from a large number of speech units can generate a synthesized speech with less loss of sound quality that is often caused due to modifying and concatenating speech units.

There is another speech synthesis method of selecting a plurality of speech units (Tatsuya Mizutani, and Takehiko Kagoshima, "Speech synthesis based on selection and fusion of a multiple unit", The Proceedings of 2004 Spring Meeting of the Acoustical Society of Japan, March 2004, Paper 1-7-3, pp. 217-218). That is, based on the level of distortion observed in a synthesized speech with any provided phonetic sequence/prosodic information set as a target, a plurality of speech units are selected for every segment of synthesis unit being a partition segment of the phonetic sequence. Thus selected speech units are fused together so that a new speech unit is generated. The resulting speech unit is then concatenated for speech synthesis.

An exemplary technique of unit fusion is pitch-cycle waveform averaging. With this technique, the synthesized speech can be increased in stability while sounding like human voice. This is because this technique can reduce the loss of sound quality that often occurs in unit selection based speech synthesizers, caused by a mismatch between the targeted phonetic sequence/prosodic information and the selected speech unit sequence, or by a discontinuity between two consecutive speech units.

As a power control technique for synthesized speech, there is provided a speech synthesis method (refer to JP-A-2001-282276) in which a speech unit is segmented at phoneme boundaries, a power estimation is made for every segment, and the power of the speech unit is changed based on thus estimated power. In a process of power estimation, a pre-calculated parameter such as a coefficient of quantification method of the first type may be used to generate the power.

In the unit selection based speech synthesizers, an optimum speech unit that minimized the cost function is selected from a large number of speech units, but the power of the selected speech unit is not always appropriate. This is why the power discontinuity is noticed, resulting in the loss of sound quality of the synthesized speech. Also in the plural-unit-selection based speech synthesizers, increasing the number of speech units for unit fusion will stabilize the power of the resulting synthesized speech. However, this means that the resulting fused speech unit is generated from many speech units varying in sound quality characteristics, resulting in the increase of sound distortion. Worse still, in the process of unit fusion, fusing speech units having the power considerably different from any appropriate power may cause loss of sound quality.

As such, in the speech synthesis method including the process of power estimation, and using a pre-calculated parameter for power control, it is difficult to perform power control while appropriately reflecting power information of a large number of speech units. With such a method, there may be a possibility of causing a power-speech unit mismatch.

In consideration of the above problems, in speech synthesis of selecting a speech unit or a plurality of speech units, an object of the present invention is to provide a speech synthesis system and method implementing high-quality speech synthesis with natural and stable speech unit power in segments of a phonetic sequence while appropriately reflecting power information of a large number of speech units.

BRIEF SUMMARY OF THE INVENTION

According to embodiments of the present invention, there is provided a speech synthesis system for generating a synthesized speech by segmenting a phonetic sequence derived from an input text by a predetermined synthesis unit, and by concatenating representative speech units each of which is extracted from respective one of the synthesis units. The speech synthesis system is provided with: a storage configured to store a plurality of speech units corresponding to the synthesis units; a selector configured to select, with respect to each of the synthesis units of the phonetic sequence derived from the input text, a plurality of speech units from the speech units stored in the storage based on a level of distortion of the synthesized speech; a representative speech generator configured to generate the representative speech unit corresponding to the synthesis units by calculating a statistics of power information from the speech units, and by correcting the power information based on the statistics of the power information in such a manner that the synthesized speech is increased in sound quality; and a speech waveform generator configured to generate a speech waveform by concatenating the generated representative speech units.

According to the present invention, a synthesized speech can be stabilized in power no matter which is applied, i.e., a speech synthesis method of selecting a speech unit, or a speech synthesis method of selecting a plurality of speech units. Compared with a method of performing power estimation in advance, derived is a synthesized speech that is appropriately reflecting the power information of a large number of speech units. This is because a plurality of speech units are selected from a large number of speech units based on cost functions for average power generation.

What is more, the power information can be used for weight assignment at the time of unit fusion, or for removing any outlier speech units so that the sound quality can be improved. As a result, derived is a synthesized speech that is stable in power with good sound quality, and the synthesized speech sounds natural.

BRIEF DESCRIPTION OF THE DRAWINGS

FIG. 4 is a diagram showing an exemplary storage of phonetic environment in a phonetic environment storage section;

FIG. 9 is a diagram showing an exemplary manner for power information correction;

DETAILED DESCRIPTION OF THE INVENTION

Figure 1:
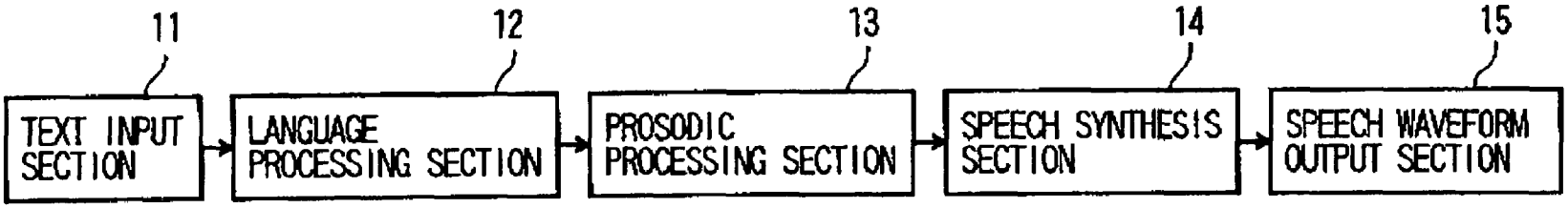
FIG. 1 is a block diagram showing the configuration of a speech synthesis system of a first embodiment of the present invention.

In embodiments of the present invention, described is a speech synthesis system for generating a synthesized speech by segmenting a phonetic sequence derived from an input text by a predetermined synthesis unit, and by concatenating representative speech units each of which is extracted from respective one of the synthesis units. The speech synthesis system is provided with: a storage section for storing a plurality of speech units corresponding to the synthesis unit; a unit selection section for selecting, with respect to each of the synthesis units of the phonetic sequence derived from the input text, a plurality of speech units from the speech units stored in the storage section based on a level of distortion of the synthesized speech; a representative speech unit generation section for generating a representative speech unit corresponding to the synthesis units by calculating a statistics of power information from the speech units, and by correcting the power information based on the statistics of the power information in such a manner that the synthesized speech is increased in sound quality; and a speech waveform generation section for generating a speech waveform by concatenating the generated representative speech units. With such a configuration, at the time of generating a synthesized speech, a plurality of speech units are selected from a speech unit group in each of the speech segments, and these speech units are corrected using a statistics of their power information. Accordingly, the resulting synthesized speech can be the one appropriately reflecting the power information of a large number of speech units.

In the unit selection section, N speech units and M speech units (N=<M) are respectively selected. In the representative speech unit generation section, thus selected M speech units are used to calculate an average value of the power information, and the N speech units are fused together to generate a fused units. The power information of the resulting fused units is so corrected as to be equalized with the average value of the power information calculated from the M speech units. In this manner, the representative speech unit is generated. With such a configuration, in a speech synthesis method of selecting and fusing a plurality of speech units, the number of speech units for the use of unit fusion is limited to N to keep the sound quality, and the average power of M speech units that is larger than N speech units is used for power correction to stabilize the power of a resulting fused unit, favorably leading to a synthesized speech sounding natural.

In an alternative configuration, in the unit selection section, M speech units and an optimum speech unit is respectively selected. In the representative speech unit generation section, thus selected M speech units are used to calculate an average value of the power information, and the optimum speech unit is so corrected that the power information thereof is equalized with the average value of the power information calculated from the M speech units. In this manner, the representative speech unit is generated. With such a configuration, in a speech synthesis method of selecting a speech unit, the selected optimum speech unit is corrected using the average power of the M speech units, and the corrected speech unit is subjected for concatenating. Therefore, the resulting synthesized speech can be stabilized in power with the high level of sound quality.

In still alternative configuration, in the unit selection section, N speech units and M speech units (N=<M) are respectively selected. In the representative speech unit generation section, thus selected M speech units are used to calculate a statistics of the power information, and the N speech units are calculated for their each power information. Based on the statistics of the power information calculated from the M speech units, weight assignment is performed to each of the N speech units. Based on such weights, the N speech units are fused together so that the representative speech unit is generated. With such a configuration, in a speech synthesis method of selecting and fusing a plurality of speech units, the weight at the time of unit fusion is reduced as the power of N speech units used for unit fusion falls outside the range of average power of the M speech units that is larger than N speech units. As a result, the resulting fused unit can be improved in sound quality, thereby deriving a synthesized speech with the high level of sound quality.

In still alternative configuration, in the unit selection section, N speech units and M speech units (N=<M) are respectively selected. In the representative speech unit generation section, thus selected M speech units are used to calculate a statistics of the power information, and the resulting statistics is used to derive a section. The N speech units are then calculated for their each power information, and if there are any power information not fitting in the section, the corresponding phoneme(s) are removed as having a deviation value. The remaining speech units are then fused together so that the representative speech unit is generated. With such a configuration, in a speech synthesis method of selecting and fusing a plurality of speech units, any outlier speech unit whose power shows a large deviation from the range of average power of the M speech units that is larger than N speech units is removed prior to unit fusion. Accordingly, by fusing the speech units after removing any outlier speech unit, the resulting fused speech unit can be improved in sound quality, thereby deriving a synthesized speech with the high level of sound quality.

In still alternative configuration, only when the power information of a fused speech unit as a result of fusing the N speech units is larger than the average value of the power information calculated from the M speech units, the fused phoneme may be so corrected that the power information thereof is equalized with the average value of the power information. With such a configuration, the power information is corrected only on a downward path. Accordingly, even if the fused unit includes some noise components, there is no possibility of amplifying the noise components, thereby successfully avoiding the loss of sound quality resulted from power correction.

In the below, the embodiments of the present invention are specifically described by referring to the accompanying drawings.

First Embodiment

Described now is a text to speech synthesis system of a first embodiment.

1. Configuration of Text to Speech Synthesis System

FIG. 1 is a block diagram showing the configuration of the text to speech synthesis system according to the first embodiment of the present invention.

This text to speech synthesis system is configured to include a text input section 11, a language processing section 12, a prosodic processing section 13, a speech synthesis section 14, and a speech waveform output section 15.

The language processing section 12 performs morpheme analysis/syntax analysis with respect to a text coming from the text input section 11. The analysis result is forwarded to the prosodic processing section 13.

The prosodic processing section 13 subjects the analysis result of language to processes of accent and intonation so that a phonetic sequence (phonetic symbol sequence) and prosodic information are generated. Thus generated sequence and information are forwarded to the speech synthesis section 14.

The speech synthesis section 14 generates speech waveforms from the phonetic sequence and the prosodic information. The resulting speech waveforms are output from the speech waveform output section 15.

2. Configuration of Speech Synthesis Section 14

Figure 2:
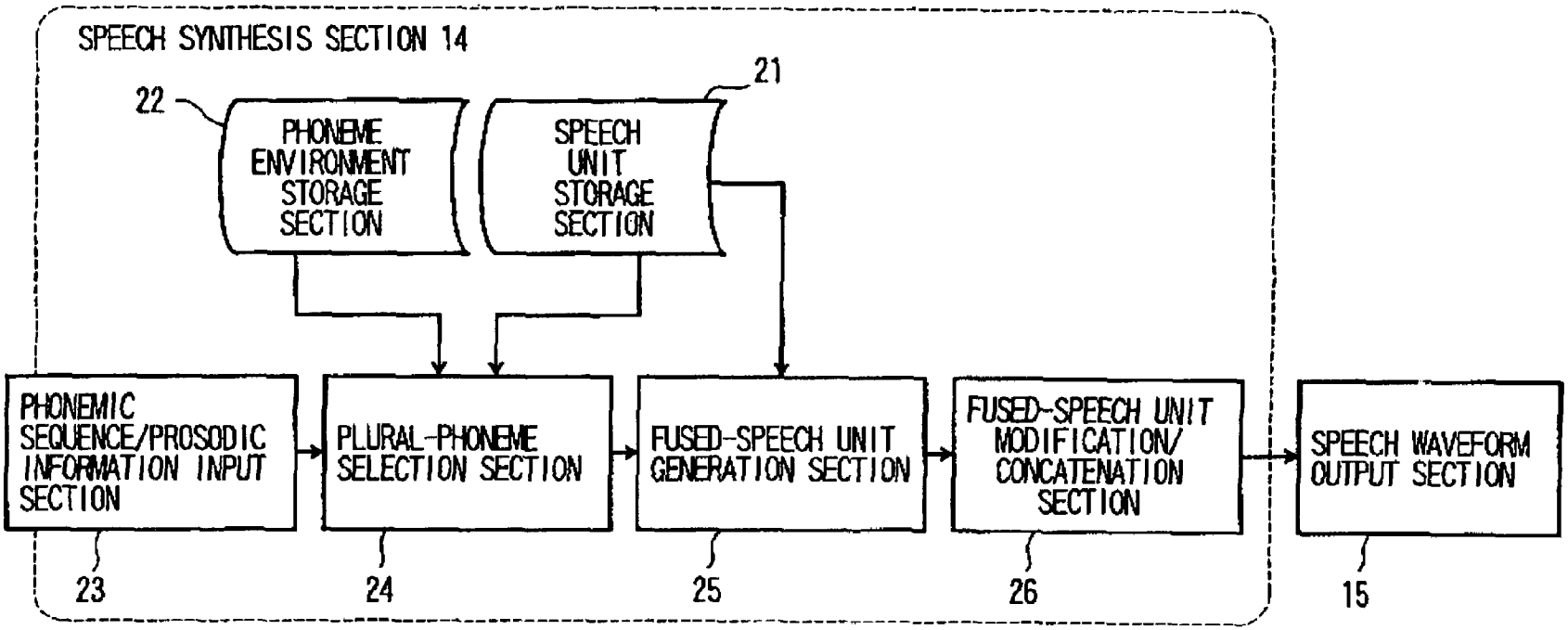
FIG. 2 is a block diagram showing an exemplary configuration of a speech synthesis section.

FIG. 2 is a block diagram showing an exemplary configuration of the speech synthesis section 14 of FIG. 1.

In FIG. 2, the speech synthesis section 14 is configured to include a speech units storage section 21, a phonetic environment storage section 22, a phonetic sequence/prosodic information input section 23, a plural-speech-unit selection section 24, a fused speech unit sequence generation section 25, and a fused speech unit modifying/concatenating section 26

2-1. Speech Unit Storage Section 21

In the speech unit storage section 21, speech units are accumulated, and information about their phonetic environment (phonetic environment information) is accumulated in the phonetic environment storage section 22.

The speech unit storage section 21 is also storing speech unit serving as type of speech unit (synthesis units) for generating a synthesized speech. The synthesis unit is a combination of phonemes or phoneme segments, including half-phoneme, phoneme (C, V), diphone (CV, VC, VV), triphone (CVC, VCV), syllable (CV, V), and others (where V denotes vowel, and C denotes consonant). The synthesis unit may be of variable length including some of these.

The phonetic environment of the speech unit denotes information corresponding to environmental factors for the speech unit. The environmental factors include phoneme name of the phoneme, preceding phoneme, subsequent phoneme, next subsequent phoneme, fundamental frequency, phonetic duration, accentuated or not, position from mainly accentuated part, time after pause, utterance speed, emotions, and others.

2-2. Phonetic Sequence/Prosodic Information Input Section 23

The phonetic sequence/prosodic information input section 23 is provided with phonetic sequence/prosodic information corresponding to the input text coming from the prosodic processing section 13. The prosodic information for provision to the phonetic sequence/prosodic information input section 23 includes the fundamental frequency, phonetic duration, and others.

In the below, the phonetic sequence/prosodic information provided to the phonetic sequence/prosodic information input section 23 is referred to as "input phonetic sequence" and "input prosodic information", respectively. The input phonetic sequence is a sequence of phonetic symbols, for example.

2-3. Plural-Speech-Unit Selection Section 24

For every synthesis unit of the input phonetic sequence, the plural-speech-unit selection section 24 estimates the distortion level of a synthesized speech. This distortion estimation is made based on the input prosodic information, and the phonetic information found in the phonetic environment of a fused speech unit. Based on the resulting distortion level estimated for the synthesized speech, the plural-speech-unit selection section 24 makes selections of speech units from those stored in the speech unit storage section 21. At this speech unit selection, M speech units are selected to derive the average power information, and N (N=<M) speech units are selected to derive a fused speech unit.

Here, the distortion level of the synthesized speech is calculated as weighted sum of a target cost and a concatenation cost. The target cost denotes a distortion observed as a difference between the phonetic environment of the speech units stored in the speech unit storage section 21 and the target phonetic environment coming from the phonetic sequence/prosodic information input section 23. The concatenation cost denotes a distortion observed as a difference of phonetic environment among any concatenating speech units.

That is, the target cost is a distortion to be caused by using the speech units stored in the speech unit storage section 21 under the target phonetic environment of any input text. The concatenation cost is a distortion to be caused due to discontinuous phonetic environment after conversion for speech unit concatenation. In the present embodiment, a cost function that will be described later is used as the distortion level of the synthesized speech.

2-4. Fused-Speech-Unit Sequence Generation Section 25

Next, in the fused-speech-unit sequence generation section 25, a fused speech unit is generated by fusing a plurality of selected speech units. For unit fusion, averaging a pitch-cycle waveform will do as will be described later. In this fused-speech-unit sequence generation section 25, the average power information is calculated for the selected M speech units, and the N speech units are fused together. The power information of the resulting fused speech unit is so corrected as to be equalized with the average power information of the M speech units. As a result, derived is a sequence of the fused speech units, the power information of which is corrected to correspond to a sequence of phonetic symbols being the input phonetic sequence. In the fused-speech-unit modifying/concatenation section 26, the sequence of fused-speech-units is deformed and concatenated on the basis of input prosodic information so that the speech waveform of a synthesized speech is generated. The resulting speech waveform is output by the speech waveform output section 15.

Note here that the "power information" is a mean square value or a mean absolute amplitude value of the speech waveform.

3. Processes of Speech Synthesis Section 14

In the below, processes to be executed by the speech synthesis section 14 are described in detail.

In this example, the synthesis unit is presumed to be a phoneme.

3-1. Speech Unit Storage Section 21

Figure 3:
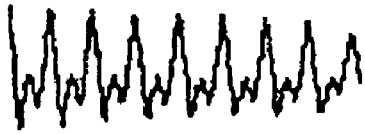
FIG. 3 is a diagram showing an exemplary speech units storage in a speech units storage section.
Figure 3:
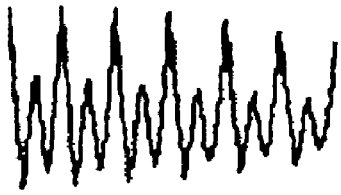
Figure 3:
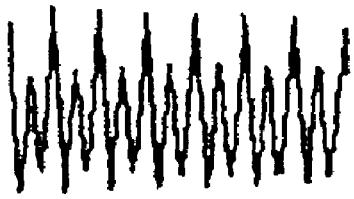

As shown in FIG. 3, in the speech unit storage section 21, speech waveforms of speech signals are stored for every speech unit together with a speech unit number for speech unit identification. As shown in FIG. 4, in the phonetic environment storage section 22, the phonetic environment information of the speech unit in the speech unit storage section 21 is stored in a correlated manner to the speech unit numbers. In this example, stored as the phonetic environment are a phonetic symbol (phoneme name), a fundamental frequency, a phonetic duration, and a concatenation boundary cepstrum.

Note that, in this example, the type of speech unit is regarded as a phoneme. Alternatively, the same is applicable if the type of speech unit is a half phoneme, diphone, triphone, syllable, or a combination thereof, or the speech unit type of variable length.

Figure 5:
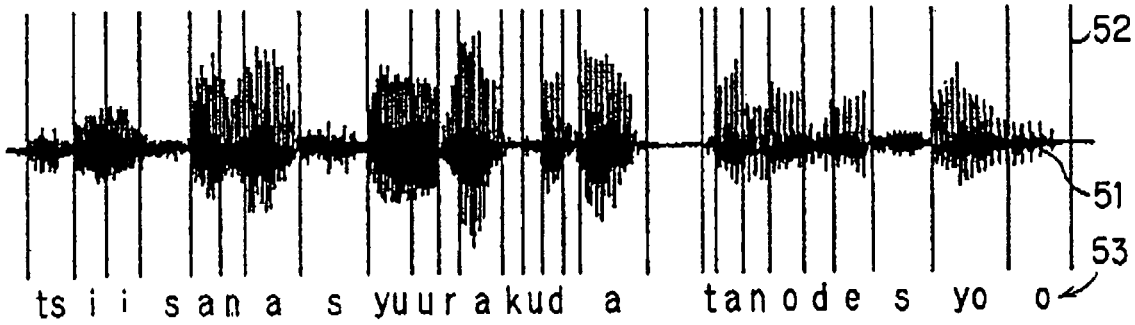
FIG. 5 is a diagram for illustrating the procedure of deriving speech units from speech data.

The speech units stored in the speech unit storage section 21 are waveforms acquired for every speech unit that is labeled in a large amount of separately-collected speech data. As an example, FIG. 5 shows the result of phoneme labeling in speech data 51. In FIG. 5, each speech data (speech waveform) segmented by a label boundary 52 on a phoneme basis is assigned with a phoneme symbol as label data 53. This speech data provides phonetic environment information for the respective phonemes, e.g., phoneme (in this example, phoneme name (phoneme symbol), fundamental frequency, and phonetic duration. The speech waveforms derived from the speech data 51 as such are assigned with the same speech unit number as their each corresponding phonetic environment. As shown in FIGS. 3 and 4, the speech unit storage section 21 and the phonetic environment storage section 22 both store such information. In this example, the phonetic environment information is presumed to include the phonological structure of the speech unit, and the fundamental frequency and the phonetic duration thereof.

3-2. Plural-Speech-Unit Selection Section 24

Described next is the plural-speech-unit selection section 24.

3-2-1. Cost Function

Described first is the cost function for use in the plural-speech-unit selection section 24 to derive a speech unit sequence.

For every factor of distortion occurring when a speech unit is modified and concatenated to generate a synthesized speech, a sub-cost function Cn (ui, ui-1, ti) (n:1, . . . , N, where N is the number of sub-cost functions) is defined. Here, when a target speech corresponding to the input phonetic sequence and the input prosodic information is t=(ti, . . . , tI), the t1 denotes the target phonetic environment information for a speech unit locating at a part corresponding to the i-th segment. The ui denotes a speech unit in the speech units stored in the speech unit storage section 21, having the same phonetic structure as the target ti.

The sub-cost function is the one for calculating the cost needed to estimate the level of distortion observed in a synthesized speech compared with a target speech. The distortion occurs when the synthesis speech is generated by using the speech units stored in the speech unit storage section 21.

For calculating such a cost, used are two types of sub-costs. One is a "target cost", estimating a level of distortion caused in a synthesized speech compared with a target speech by using the speech units stored in the speech unit storage section 21. The other is a "concatenation cost", estimating a level of distortion caused in a synthesized speech compared with a target speech by concatenating the speech units stored in the speech unit storage section 21 with any other speech units.

The target cost includes a fundamental frequency cost, and a phonetic duration cost. The fundamental frequency cost represents a difference between a target fundamental frequency and the fundamental frequency of the speech units stored in the speech unit storage section 21, and the phonetic duration cost represents a difference between a target phonetic duration and the phonetic duration of the speech units in the speech unit storage section 21.

The concatenation cost includes a spectrum concatenation cost, representing a spectrum difference at the concatenation boundaries. To be specific, the fundamental frequency cost is calculated from the following equation (1):

$$C_1(u_i,u_{i-1},t_1)=\{\log(f(v_i))-\log(f(t_i))\}^2 \quad (1)$$

where Vi denotes the phonetic environment of a speech unit ui stored in the speech unit storage section 21, and f denotes a function for extracting the average fundamental frequency from the phonetic environment vi. The phonetic duration cost is calculated from the following equation (2):

$$C_2(u_i,u_{i-1},t_i)=\{g(v_i)-g(t_i)\}^2 \quad (2)$$

where g denotes a function for extracting the phonetic duration from the phonetic environment vi. The spectrum concatenation cost is calculated from a cepstrum distance between any two speech units:

$$C_3(u_i,u_{i-1},t_i)=\|h(u_i)-h(u_{i-1})\| \quad (3)$$

where h denotes a function for extracting, as a vector, a cepstrum coefficient at a concatenation boundary of the speech unit ui. The weighted sum of these sub-cost functions is defined as a synthesis unit cost function:

$$C(u_i, u_{i-1}, t_i) = \sum_{n=1}^{N} w_n C_n(u_i, u_{i-1}, t_i) \quad (4)$$

where wn represents the weight of the sub-cost function. In the present embodiment, for brevity, wn is presumed to be "1" without exception. The equation (4) is a synthesis unit cost of a speech unit assigned to a specific synthesis unit.

The cost denotes the sum of the synthesis unit costs calculated from the equation (4) on a segment basis. Here, the segments are those derived by partitioning the input phonetic sequence by a synthesis unit. The cost function for calculating such a cost is defined as shown in the following equation (5):

$$\text{Cost} = \sum_{i=1}^{I} C(u_I, u_{i-1}, t_i) \quad (5)$$

3-2-2. Speech Unit Selection Process

The plural-speech-unit selection section 24 uses the cost functions shown in the above equations (1) to (5) to select a plurality of speech units per segment, i.e., per synthesis unit, in two steps.

Figure 6:
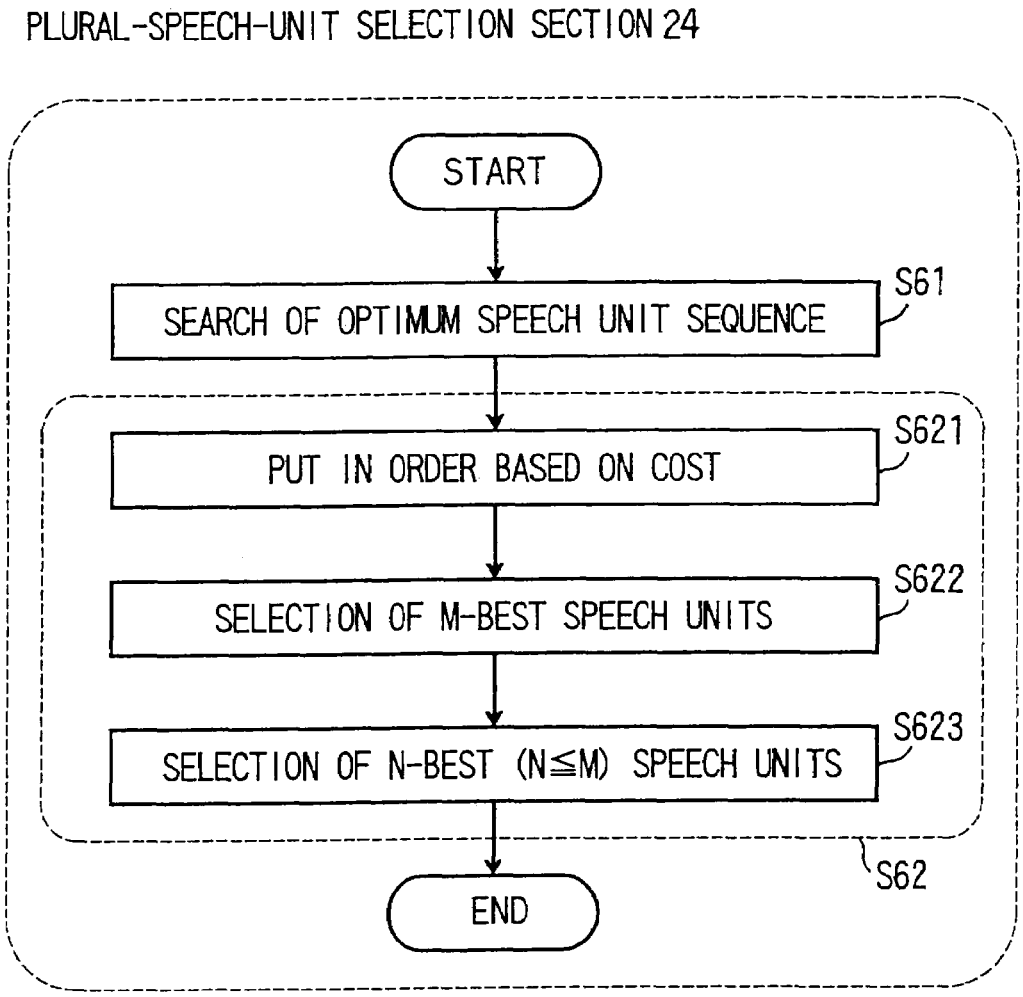
FIG. 6 is a flowchart for illustrating the process operation of a plural speech unit selection section.

FIG. 6 is a flowchart for illustrating a speech unit selection process.

As speech unit selection in the first step, in step S61, a group of speech units stored in the speech unit storage section 21 is subjected to selection of a speech unit sequence, having the minimum cost value as a calculation result of the equation (5). The resulting combination of speech units having the minimum cost as such is hereinafter referred to as optimum speech unit sequence. That is, the speech units in such an optimum speech unit sequence are respectively corresponding to a plurality of segments as a result of partitioning the input phonetic sequence by a synthesis unit. The synthesis unit cost calculated from each of the speech units in the optimum speech unit sequence and the cost calculated by the equation (5) are all smaller in value compared with any other speech unit sequence. Here, for search of such an optimum speech unit sequence, using Dynamic Programming (DP) will increase the efficiency.

The procedure then goes to step S62 for the speech unit selection in the second step. In step S62, the optimum speech unit sequence is used to select a plurality of speech units for every segment. In this example, for the description of step S62, the number of segments is J, and for every segment, M speech units are selected to derive the average power information, and N speech units are selected for the use of speech unit fusion.

3-2-3. Method of Selecting a Plurality of Speech Units for Every Segment

In steps S621 to S623, a specific segment in other J segments is regarded as a target segment. The procedure from step S621 to S623 is repeated for J times, and a process is so executed that all of the J segments each serve as a target segment for once.

First of all, in step S621, the segments not serving as a target segment are each assigned with a speech unit in the optimum speech unit sequence. Under this state, for the target segment, the speech units stored in the speech unit storage section 21 are put in order based on the cost value of the equation (5). The M-best speech units are then selected to derive the average power information, and the N-best speech units are also selected for the use of speech unit fusion.

Figure 7:
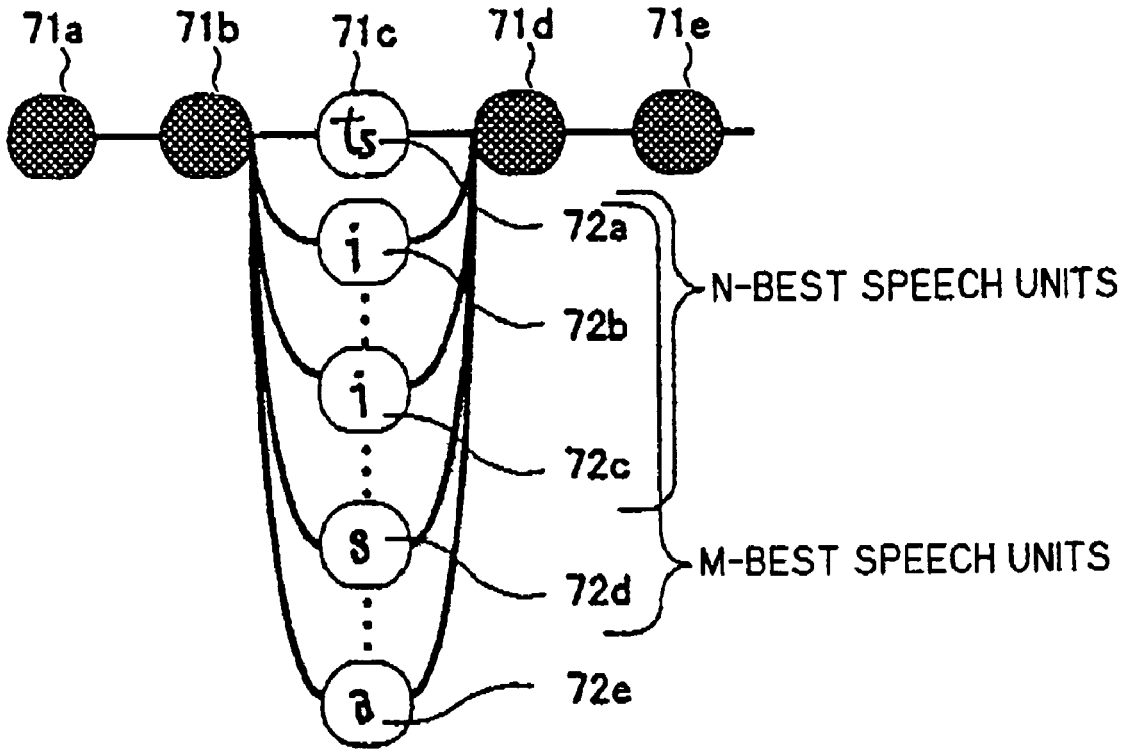
FIG. 7 is a diagram for illustrating the procedure of deriving a plurality of speech units for each of a plurality of segments of an input phonetic sequence.

As shown in FIG. 7, assumed here is that the input phonetic sequence is of "ts·i·i·s·a· . . . ". With this being the case, the synthesis unit corresponds each of such speech units of "ts", "i", "i", "s", "a", and others, and each of these speech units corresponds to a segment. In FIG. 7 example, a target segment is a segment corresponding to the third speech unit "i" in the input phonetic sequence. FIG. 7 example shows a case of selecting a plurality of speech units for this target segment. The segments other than the segment corresponding to the third speech unit "i" are assigned with the speech units in the optimum speech unit sequence, i.e., 71*a*, 71*b*, 71*d*, 71*e*, and others.

Under this state, out of the speech units stored in the speech unit storage section 21, the equation (5) is used to calculate the cost for each of the speech units having the same phoneme name (phoneme symbol) as the phoneme "i" of the target segment. Here, at the time of cost calculation as such, there may need to pay attention only to costs changing in value, i.e. the target cost of the target segment, the concatenation cost of the target segment and the segment preceding thereto, and the concatenation cost of the target segment and the segment subsequent thereto. More in detail, (Procedure 1) Out of the speech units stored in the speech unit storage section 21, a specific speech unit having the same phoneme name (phonetic symbol) as the phoneme "i" in the target segment is regarded as a speech unit u3. Using the equation (1), a fundamental frequency cost is then calculated from the fundamental frequency f(v3) of the speech unit u3, and a target fundamental frequency f(t3).

(Procedure 2) Using the equation (2), a phonetic duration cost is calculated from the phonetic duration g (v3) of the speech unit u3, and a target phonetic duration g(t3).

(Procedure 3) Using the equation (3), a first spectrum concatenation cost is calculated from a cepstrum coefficient h(u3) of the speech unit u3, and a cepstrum coefficient h(u2) of a speech unit 51*b* (u2). Also using the equation (3), a second spectrum concatenation cost is calculated from a cepstrum coefficient h(u3) of the speech unit u3, and a cepstrum coefficient h(u4) of a speech unit 51*d*(u4).

(Procedure 4) The cost of the speech unit u3 is calculated by calculating the weighted sum of the costs derived by using the sub-cost functions in the above procedures 1 to 3, i.e., the fundamental frequency cost, the phonetic duration cost, and the first and second spectrum concatenation costs.

(Procedure 5) After cost calculation in accordance with the above procedures 1 to 4 for each of the speech units in the speech unit storage section 21 having the same phoneme name (phoneme symbol) as the phoneme "i" of the target segment, the speech units are put in ascending order based on their costs (step S621 of FIG. 6). In FIG. 7 example, the speech unit 72*a* is highest in order, and the speech unit 72*e* is lowest in order. Thereafter, the M-best speech units, i.e., speech units 72*a* to 72*d*, are selected to derive the average power information (step S622 in FIG. 6), and the N-best (N=<M) speech units, i.e., speech units 72*a* to 72*c*, are selected for the use of unit fusion (step S623 in FIG. 6).

The above procedures 1 to 5 are executed to every segment, thereby selecting M and N speech units for every segment.

3-3. Fused-Speech Unit Generation Section 25

Described next is the fused-speech unit generation section 25.

The fused-speech unit generation section 25 fuses a plurality of speech units selected by the plural-speech-unit selection section 24, and generates a fused speech unit.

3-3-1. Process of Fused-Speech-Unit Generation Section 25

Figure 8:
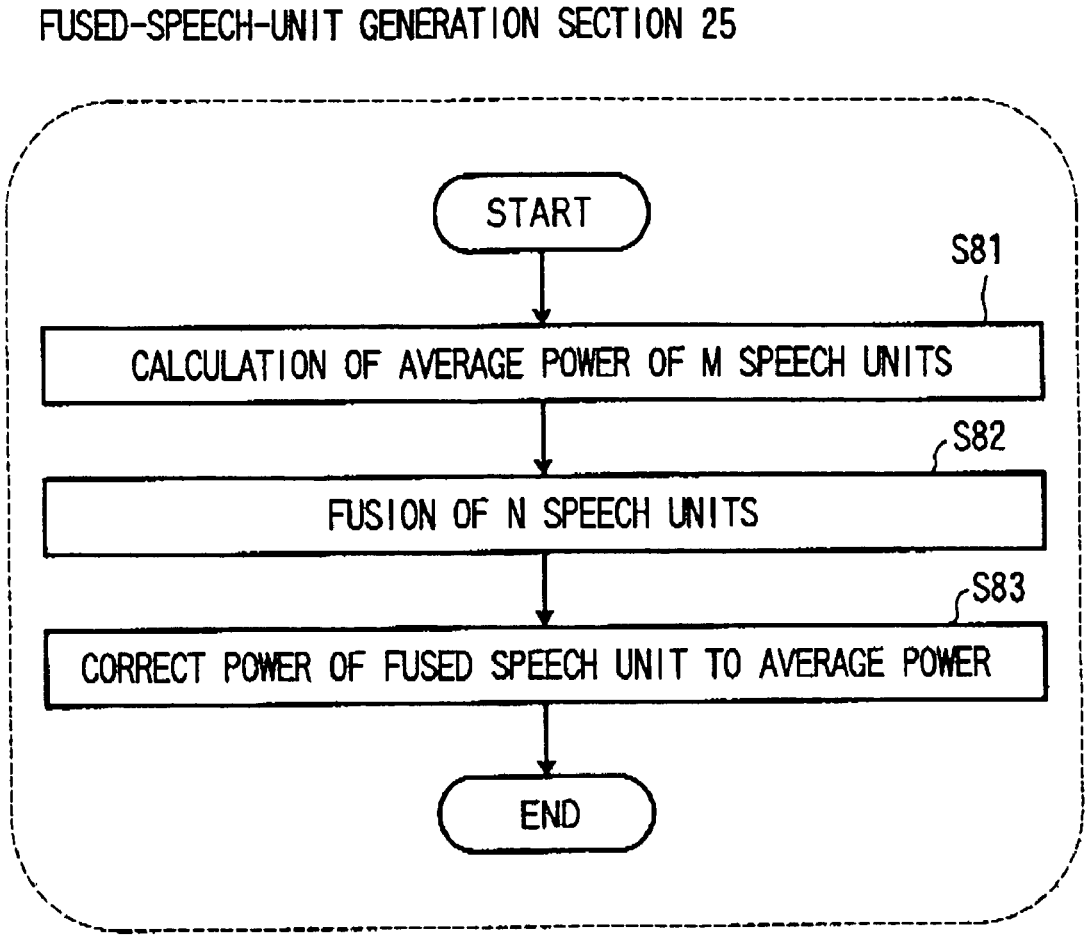
FIG. 8 is a flowchart for illustrating the process operation of a fused speech unit generation section.

FIG. 8 shows a process to be executed by the fused-speech-unit generation section 25.

First of all, in step S81, the average power information is derived for the selected M speech units. That is, average power information pi is calculated for each speech from the following equation (6):

$$P_i = \frac{1}{T}\sum_{t=1}^{T} S_i(t)^2 \tag{6}$$

An average value Pave of thus calculated power information pi (1=<i=<M) is calculated using the following equation (7), and the average power information of the M speech units is derived:

$$P_{ave} = \frac{1}{M}\sum_{m=1}^{M} P_m \tag{7}$$

where si (n) denotes a speech signal of the ith speech unit, and T denotes the number of samples.

Next, in step S82, the N speech units are fused together with a unit fusion method, which will be described later. The N speech units selected by the plural-speech-unit selection section 24 are acquired from the speech unit storage section 21. The N speech units are then fused together to generate a new speech unit (fused speech unit).

Lastly, in step S83, the power information of the fused speech unit is corrected to be equalized with the average power information Pave. The power information Pf of the fused speech unit is derived from the equation (6), and a ratio r for correcting the power information is derived from the following equation (8):

$$r = \sqrt{\frac{P_{ave}}{P_f}} \tag{8}$$

The resulting ratio r is multiplied to the fused speech unit so that the power information is corrected.

For brevity, the power information Pf of the fused speech unit may be an average value of the power information Pi of the N speech units (1=<I=<N).

3-3-2. Correction of Power Information

FIG. 9 shows an exemplary manner for power information correction. The table of FIG. 9 shows the power information Pi (1=<i=<M) of the M-best (M=15) speech units selected for the speech unit i. In this example, the synthesis unit is a half phoneme. When N is 3, the power information Pf of the fused speech unit will be 2691671, and the average power information Pave of the M speech units will be 1647084. The ratio r for power information correction will be 0.78, which is multiplied to the speech waveform of the fused speech unit so that the power information is corrected.

Figure 10A:
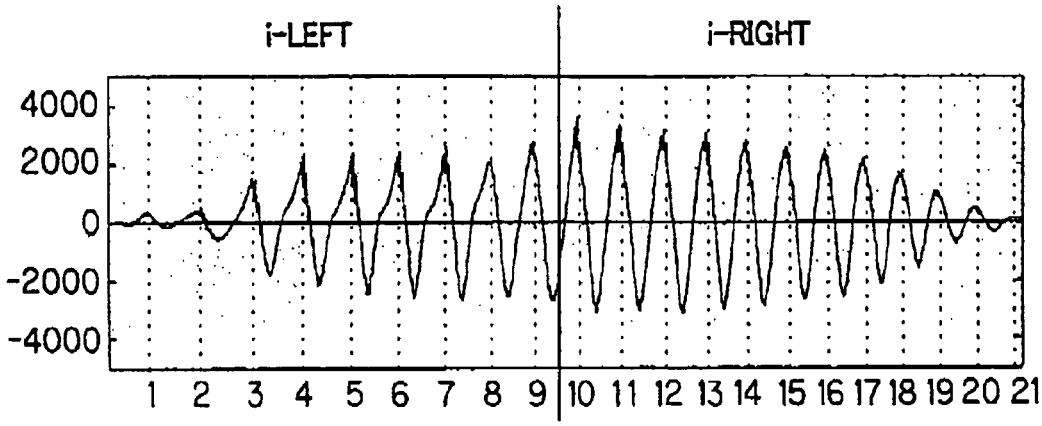
FIGS. 10A and 10B are both a diagram showing another exemplary manner for power information correction.
Figure 10B:
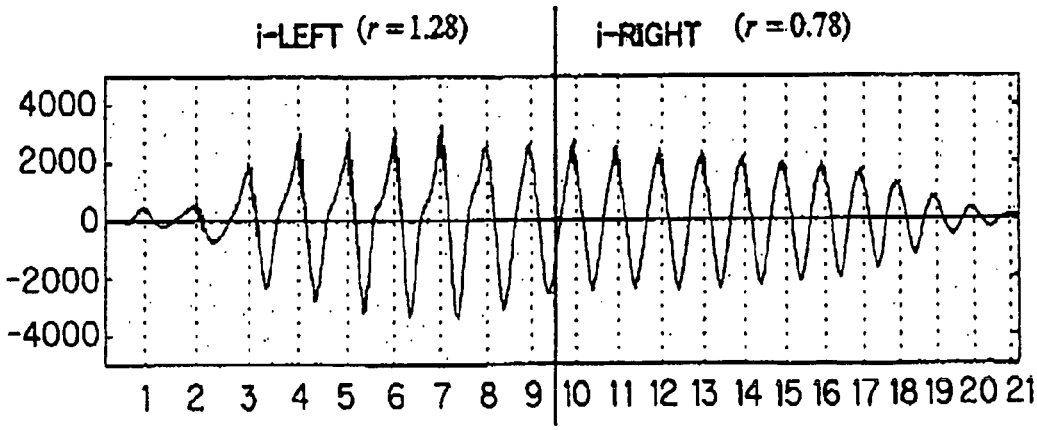
Figure 11:
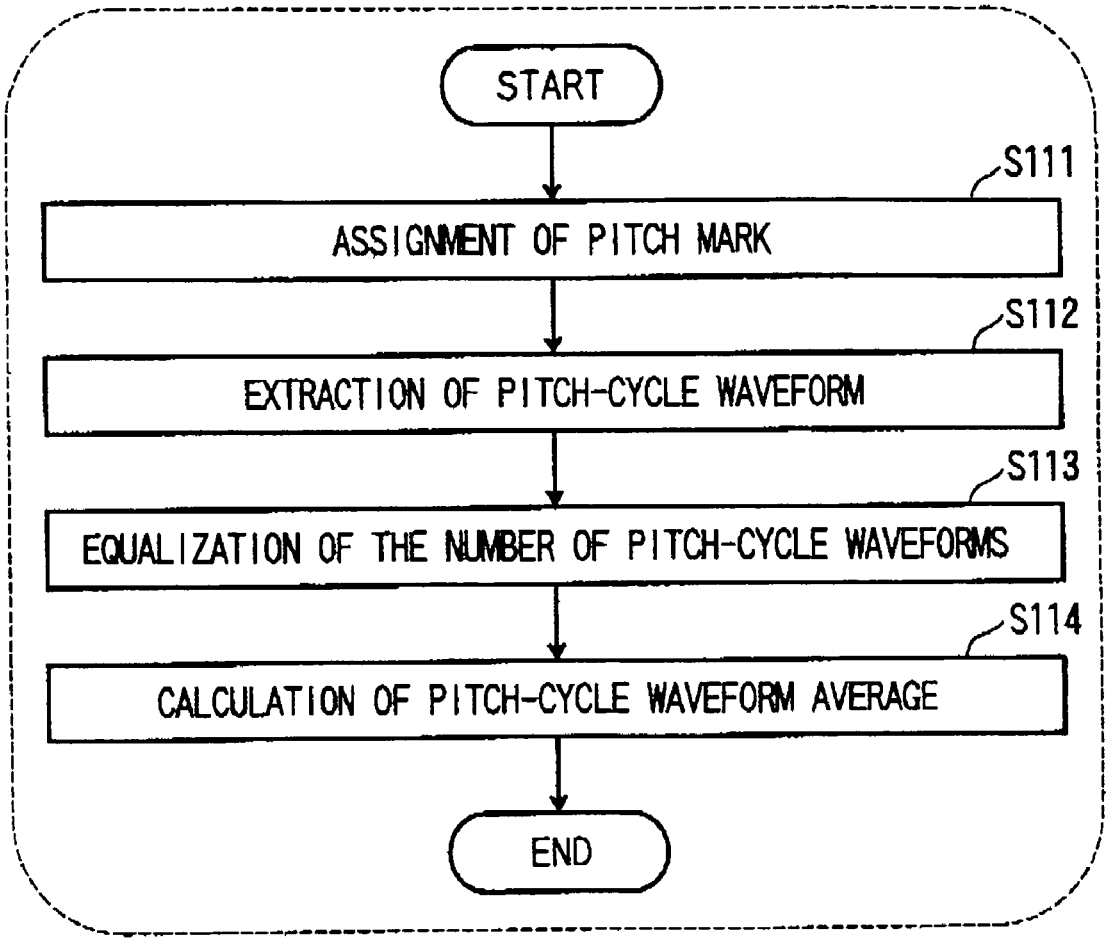
FIG. 11 is a flowchart for illustrating the process in unit fusion step.

FIGS. 10A and 10B both show an exemplary waveform as a result of power information correction. FIGS. 10A and 10B both show the phoneme i at the head. FIG. 10A shows a case where the fused speech unit is concatenated as it is with no correction, and FIG. 10B shows a case of power information correction according to the present invention. The numbers along a lateral axis denote pitch mark numbers. FIG. 11A example shows an abrupt increase of the power information in a range of the pitch mark numbers 9 to 10, the concatenation part in the phoneme i between the left and right half speech units. On the other hand, FIG. 10B shows a smooth concatenation at the concatenation part with the ratio r of 1.28 for the left half speech unit, and the ratio r of 0.78 for the right half speech unit. Herein, the right half speech unit is corresponding to FIG. 9.

3-3-3. Method of Speech Unit Fusion

Described next is a method of speech unit fusion in step S82. In this step, two different types of processes are executed depending on whether the speech unit is a voiced or unvoiced sound.

3-3-3-1. With Voiced Sound

Described first is a case with a voiced sound. In the case with a voiced sound, speech unit fusion is performed at the level of a pitch-cycle waveform that is extracted from a speech unit. In this manner, a new pitch-cycle waveform is generated. Here, the pitch-cycle waveform is relatively short, about the length of several-fold of the pitch period, and the pitch-cycle waveform itself has no pitch period. The spectrum of the pitch-cycle waveform represents a spectrum envelope of a speech signal.

There are various techniques for waveform extraction, e.g., simply using a pitch synchronization window for waveform extraction, subjecting to inverse discrete Fourier transform the power spectrum envelop as a result of cepstrum analysis or PSE analysis, deriving a pitch-cycle waveform by filter impulse response as a result of linear prediction analysis, or deriving a pitch-cycle waveform by the closed loop training to reduce a distortion of a synthesized speech compared with a natural speech.

Exemplified here is a case of extracting a pitch-cycle waveform with the technique of using a pitch synchronization window. By referring to the flowchart of FIG. 11, described here is the process procedure for a case of generating a new speech unit by fusing the N speech units selected by the plural-speech-unit selection section 24.

Figure 12A:
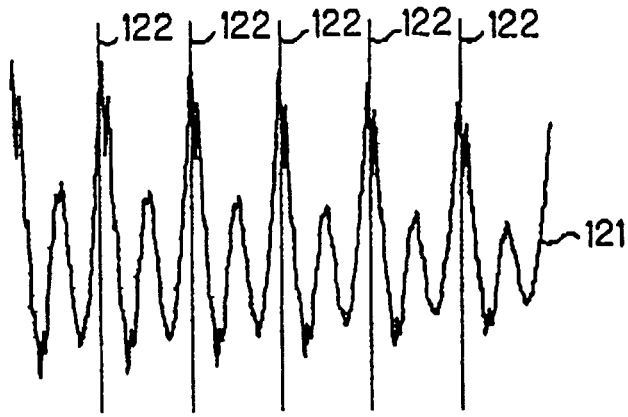
FIGS. 12A to 12C are all a diagram for illustrating the process of a unit fusion section.

In step S111, speech waveforms of the N speech units are each assigned with a mark (pitch mark) at every pitch interval. FIG. 12A shows an exemplary case where a speech waveform 121 of a specific speech unit out of the N others is assigned with a pitch mark 122 at every pitch interval.

Figure 12B:
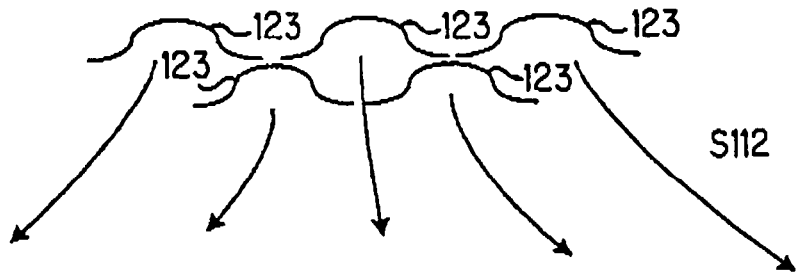
Figure 12C:
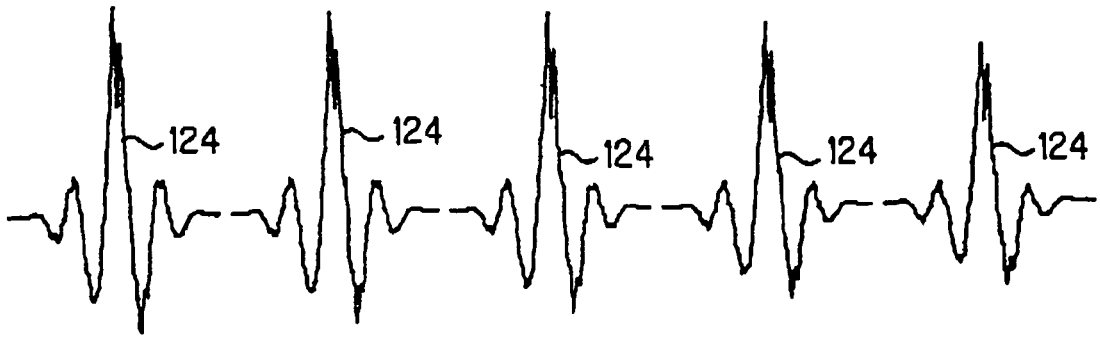

In step S112, as shown in FIG. 12B, a pitch-cycle waveform is extracted by windowing performed with reference to the pitch marks. The window is a Hanning window 123, the window length of which is twice as long as the pitch period. Thereafter, as shown in FIG. 12C, windowed waveforms 124 are extracted as pitch-cycle waveforms. Such a process of FIGS. 12A to 12C, i.e., process of step S112, is executed to each of the N speech units. As a result, a sequence of a plurality of pitch-cycle waveforms is derived for each of the N speech units.

The procedure then goes to step S113, and waveform replication is performed to equalize the number of pitch-cycle waveforms in the pitch-cycle waveform sequences for each of the N speech units in the segment, i.e., specifically for the sequences including fewer pitch-cycle waveforms. Such waveform replication is performed based on the largest number of pitch-cycle waveforms in the sequence.

Figure 13:
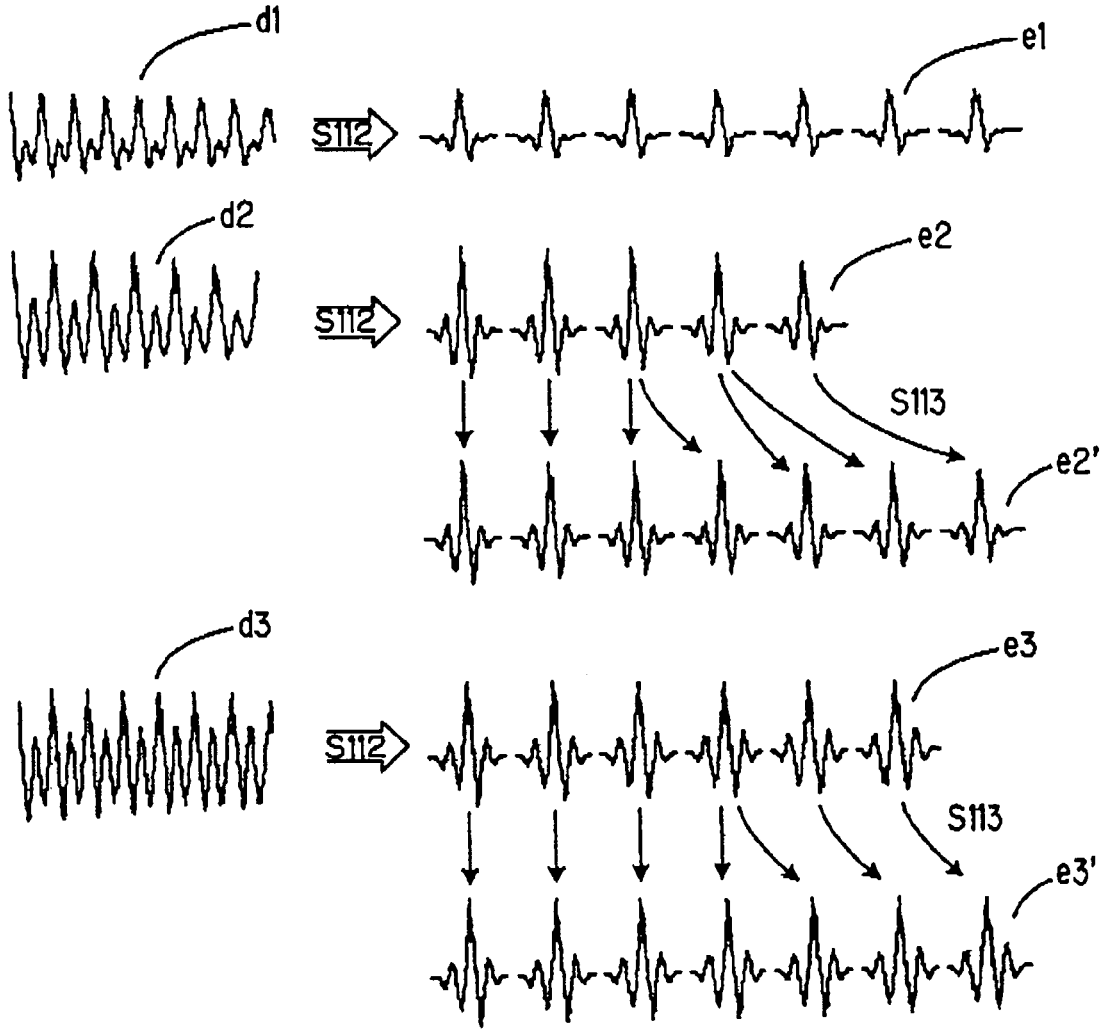
FIG. 13 is another diagram for illustrating the process of the unit fusion section.

FIG. 13 shows pitch-cycle waveform sequences e1 to e3 as a result of waveform extraction in step S112, performed from N (e.g., 3 in this example) speech units d1 to d3 of the segment. The sequence e1 carries seven pitch-cycle waveforms, the sequence e2 carries five, and the sequence e3 carries six. As such, among these pitch-cycle waveform sequences e1 to e3, the sequence e1 carries the largest number of pitch-cycle waveforms. Based thus on the number of the pitch-cycle waveforms in the sequence e1, i.e., seven in this example, any waveform in the remaining respective sequences e2 and e3 is replicated until the number of the pitch-cycle waveforms becomes seven. The resulting new pitch-cycle waveform sequences are e2' and e3' respectively corresponding to the sequences e2 and e3.

The procedure then goes to step S114. In step S114, a process is executed to every pitch-cycle waveform. The pitch-cycle waveform corresponding to each of the N speech units in the segment is averaged based on the position so that a sequence of new pitch-cycle waveforms is generated. The resulting sequence of new waveforms is referred to as a fused speech unit.

Figure 14:
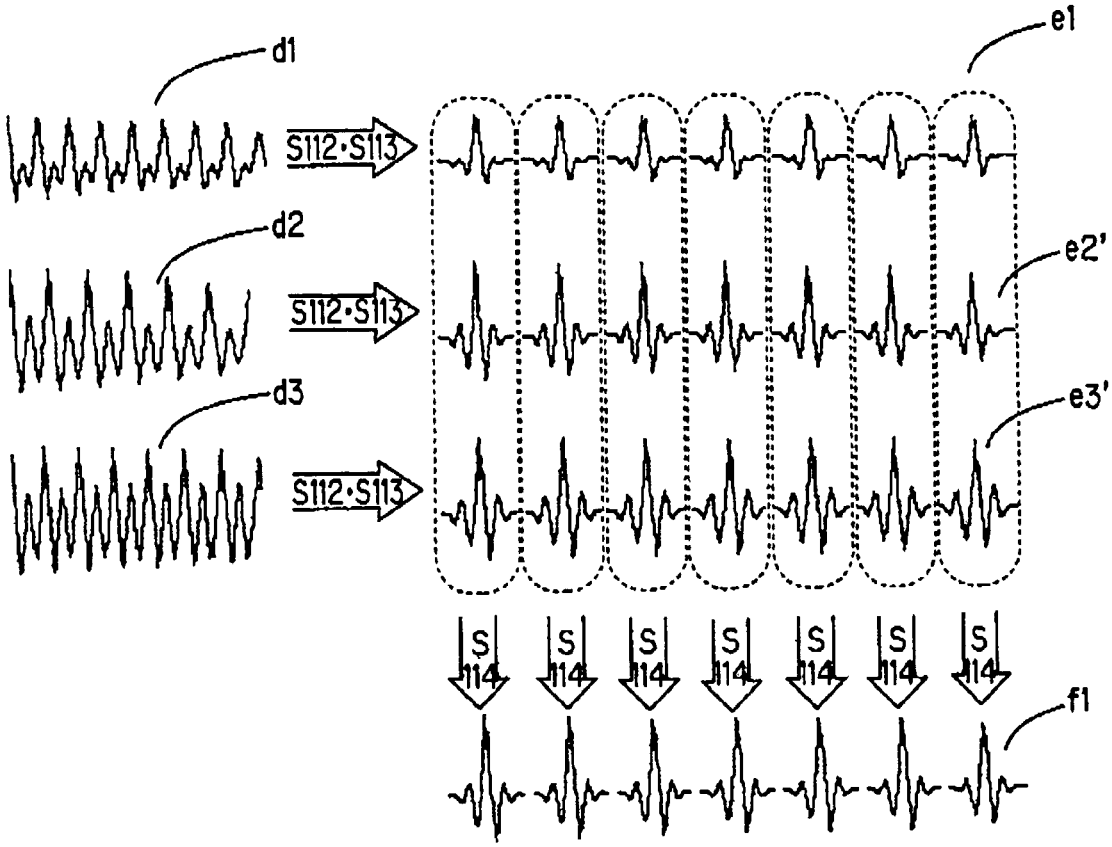
FIG. 14 is still another diagram for illustrating the process of the unit fusion section.

FIG. 14 shows the pitch-cycle waveform sequences e1, e2', and e3' derived in step S113 from the N (e.g., 3 in this example) speech units d1 to d3 of the segment. As these sequences each have seven pitch-cycle waveforms, in step S114, 1st to 7th pitch-cycle waveforms are each averaged by three speech units. In this manner, a sequence f1 of new pitch-cycle waveforms, i.e., seven new pitch-cycle waveforms, is generated. That is, for example, a centroid of the 1st pitch-cycle waveform of the sequence e1, the first pitch-cycle waveform of the sequence e2', and the first pitch-cycle waveform of the sequence e3' is derived, and the result is regarded as the 1st pitch-cycle waveform of the new pitch-cycle waveform sequence f1. The same process is executed to derive the 2nd to 7th pitch-cycle waveforms of the new pitch-cycle waveform sequence f1. The pitch-cycle waveform sequence f1 is the above-described "fused speech unit". To derive a centroid, alternatively, each pitch-cycle waveform may be weighted. With this being the case, the new pitch-cycle waveform sequence f1 is derived by a weighted average with the weight w1 for the sequence e1, the weight w2 for the sequence e2, and the weight w3 for the sequence-e3.

$$f1 = \sum_{i=1}^{N} w_i e_i' \tag{9}$$

$$\sum_{i=1}^{N} w_i = 1$$

In the equation (9), the weight wi is assumed as being normalized.

Such pitch-cycle waveform averaging is not the only option for a unit fusion process executed to the pitch-cycle waveforms. For example, the closed loop training leads to any optimum pitch-cycle waveform sequence at the level of a synthesized speech without the need for extracting a pitch-cycle waveform from each of the speech units. Here, the closed loop training is a technique of generating a representative speech unit showing less distortion compared with a natural speech at the level of a speech synthesized by actually changing the fundamental frequency and phonetic duration. As such, because the resulting speech unit generated by the closed loop training shows less distortion at the level of the synthesized speech, the resulting speech unit is higher in sound quality than a speech unit generated by pitch-cycle waveform averaging. For details, refer to Japanese Registered Patent No. 3281281.

3-3-3-2. With Unvoiced Sound

In the processing step of speech unit fusion, with a segment of unvoiced sound, the waveform of the speech unit taking the first place among the N speech units selected by the plural-speech-unit selection section 24 for the segment is used as it is.

3-4. Fused-Speech-Unit Modification/Concatenation Section 26

The fused-speech unit modification/concatenation section 26 generates a speech waveform of a synthesized speech by modifying and concatenating a fused speech unit in accordance with the input prosodic information. The fused speech unit actually takes the shape of a pitch-cycle waveform. Accordingly, a speech waveform can be generated by concatenating together the pitch-cycle waveforms in such a manner that the fused speech unit has the fundamental frequency and the phonetic duration of the target speech found in the input prosodic information.

Figure 15:
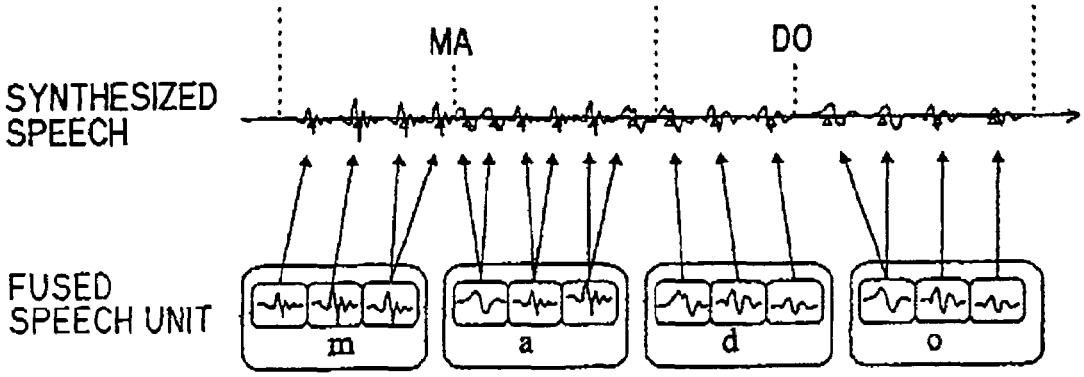
FIG. 15 is a diagram for illustrating the process operation of a unit modification/concatenation section.

FIG. 15 is a diagram for illustrating the process to be executed by the fused-speech unit modification/concatenation section 26. In FIG. 15, exemplified is a case of generating a speech waveform of "ma-do" by modifying and concatenating the fused speech units derived by a speech unit fusion section for the respective synthesis units of the speech units of "m", "a", "d", and "o". As shown in FIG. 15, based on the target fundamental frequency and the target phonetic duration found in the input prosodic information, in the fused speech unit, the fundamental frequency of the respective pitch-cycle waveforms may be changed (the pitch may be changed), or the number of the pitch-cycle waveforms may be increased (duration may be changed). Thereafter, any pitch-cycle waveforms adjacent in the segment or between segments are concatenated together to generate a synthesized speech.

As described in the foregoing, in the present embodiment, for the speech synthesis method of selecting a plurality of speech units, N speech units are selected for the use of speech unit fusion, and M (N=<M) speech units are selected to derive the power information. The power information of the fused speech unit is then so corrected as to be equalized with the average power information of the M speech unit. As a result, derived is a synthesized speech sounding natural with less discontinuity of speech unit concatenation.

4. Modified Examples 4-1. Modified Example 1

In the above embodiment, the power information of a fused speech unit is corrected to be equalized with the average power information of the M speech units. This is not restrictive, and the power information of the N speech units may be corrected in advance to be equalized with the average power information of the M speech units, and the resulting corrected N speech units may be fused together.

Figure 16:
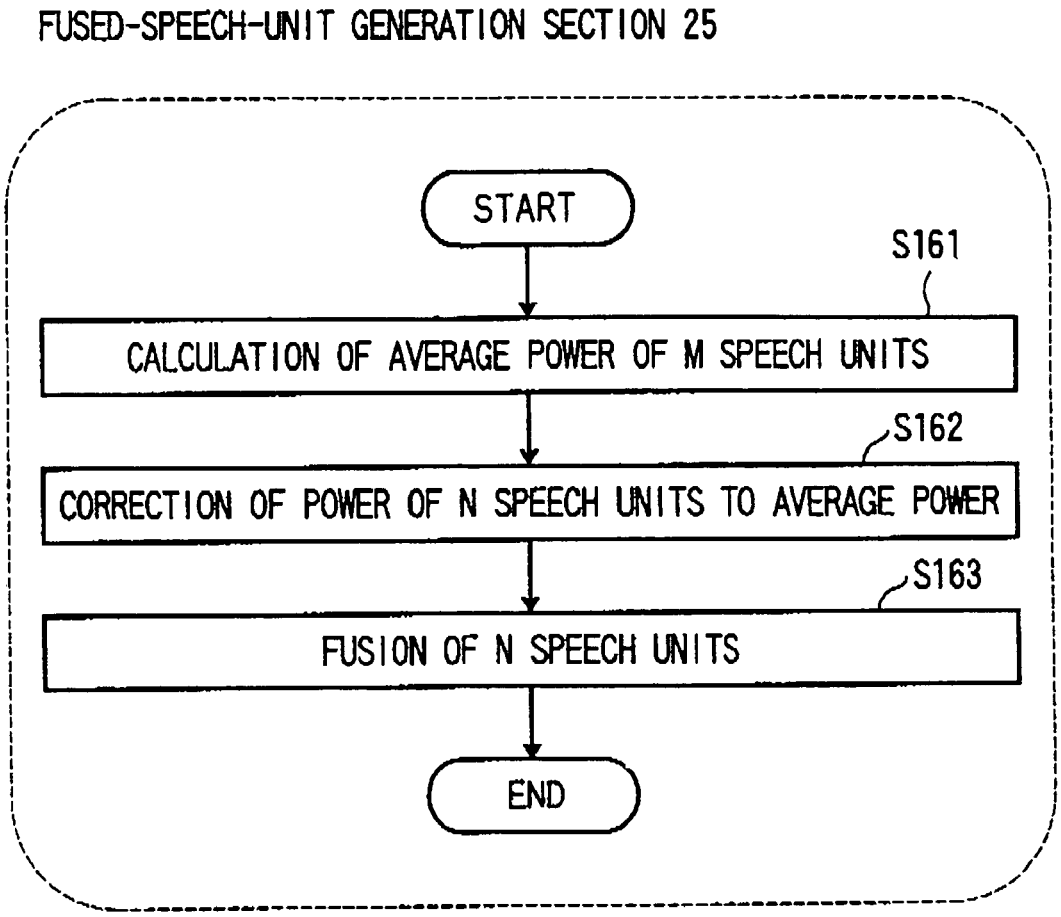
FIG. 16 is another flowchart for illustrating the process operation of the fused speech unit generation section.

With this being the case, the fused-speech unit generation section 25 goes through the process as shown in FIG. 16. That is, in step S161, the fused-speech unit generation section 25 calculates the average power information of the M speech units using the equations (6) and (7). In step S162, the N speech units are each corrected to have the power average Pave, and in step S163, the resulting corrected speech units are fused together so that a fused speech unit is generated.

4-2. Modified Example 2

In the above embodiment, the power information of a fused speech unit is corrected to be equalized with the average power information of the M speech units. Alternatively, a ratio may be derived for the use of power information correction. In this case, the average power information is first derived for the M speech units and N speech units, respectively. A ratio is then calculated to equalize the average power information of the N speech units to the average power information of the M speech units. The resulting ratio is then multiplied to each of the N speech units so that the N speech units are accordingly corrected. Fusing thus corrected N speech units will generate a fused speech unit.

Figure 23:
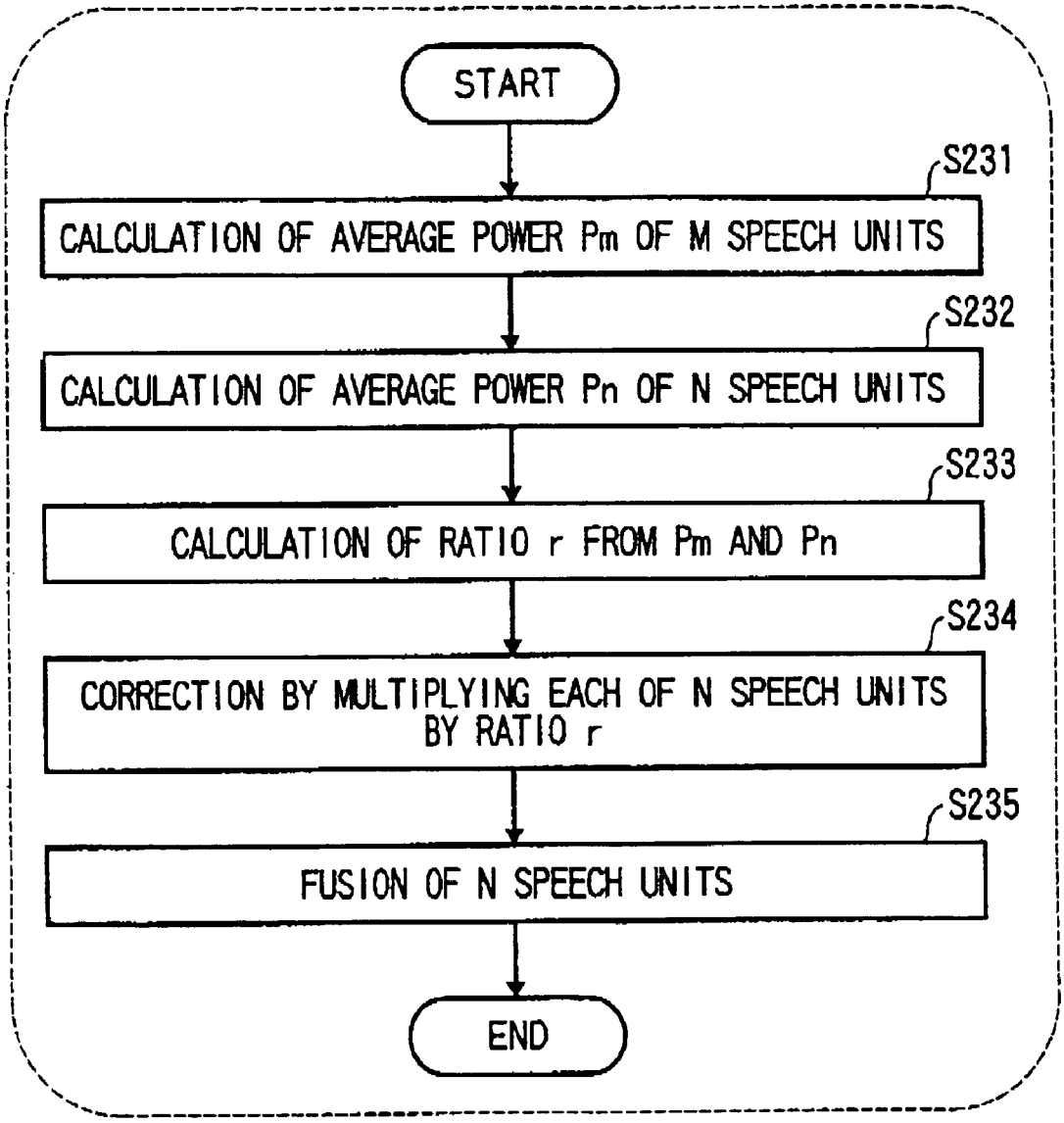
FIG. 23 is a flowchart for illustrating the process operation of the fused speech unit generation section.

With this being the case, as shown in FIG. 23, the fused-speech-unit generation section 26 goes through steps of 231 to 235 to generate a fused speech unit. More in detail, in step S231, the average power information Pave is calculated for the M speech units using the equations (6) and (7). Similarly, in step S232, the average power information Pf is calculated for the N speech units in step S232. In step S233, from thus calculated average power information Pf and Pave, the ratio r is calculated using the equation (8). Then in step S234, the N speech units are each multiplied by the ratio r for their correction. In step S235, thus corrected N speech units are fused together so that a fused-speech-unit is generated.

4-3. Modified Example 3

Further, in the present embodiment, the power information is assumed as being a mean square value that is represented by the equation (6). If the power information is assumed as being a mean absolute amplitude value, as an alternative to the equation (6), the following equation (10) may be used, and as an alternative to the equation (8), a mean absolute amplitude ratio may be used.

$$A_i = \frac{1}{T}\sum_{t=1}^{T}|S_i(t)| \tag{10}$$

$$r = \frac{A_{ave}}{A_f} \tag{11}$$

This may eliminate the need for square root calculation, and allow calculation only by integer operation.

4-4. Modified Example 4

In step S83 of FIG. 8 and step S162 of FIG. 16, i.e., in steps of correcting the power information of a fused or selected speech units, the power information may be corrected only when the correction ratio r derived by the equation (8) or (11) is smaller than 1.0. This is aimed to put the power information only on a downward path, thereby favorably preventing noise components from being amplified in the speech unit(s).

Second Embodiment

Described next is the fused-speech-unit generation section 25 of a second embodiment.

Figure 17:
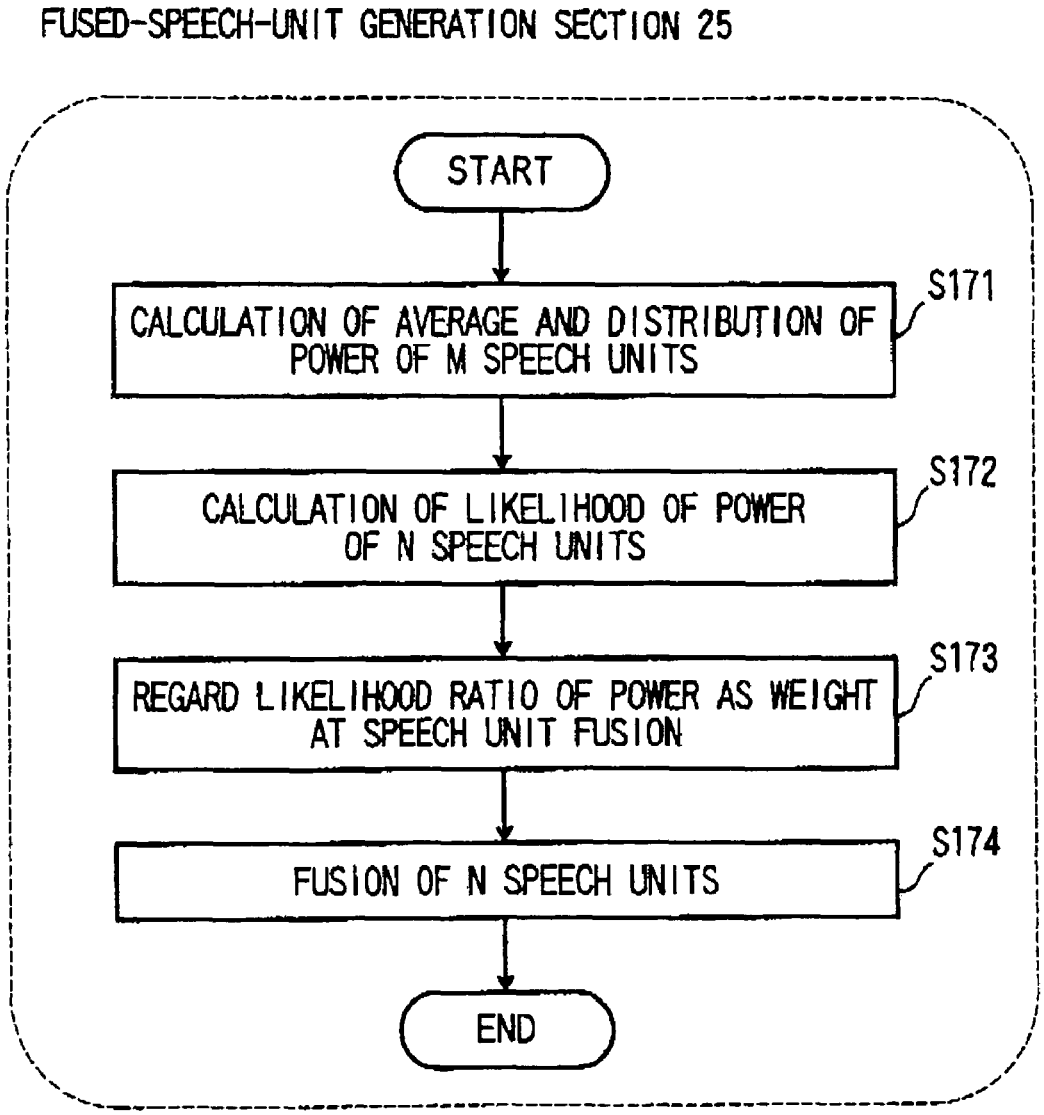
FIG. 17 is a flowchart for illustrating the process operation of a fused speech unit generation section in a second embodiment of the present invention.

FIG. 17 shows a process to be executed by the fused-speech unit generation section 25 of the second embodiment.

In the second embodiment, the statistic of M (M>0) pieces of power information is used to determine the weight wi in the equation (9) for the fused speech unit.

In step S171 of FIG. 17, calculated is average and variance of the power information of the M speech units selected in the plural-speech-unit selection section 24.

The procedure then goes to step S172, and calculated is a likelihood of the power information of the N speech units for the use of speech unit fusion. The likelihood is calculated by the following equation (12) with an assumption of Gaussian distribution.

$$p(Pi\,|\,\mu,\sigma^2) = \frac{1}{\sqrt{2\pi\sigma}}\exp\left[-\frac{(P_i-\mu)^2}{2\sigma^2}\right] \tag{12}$$

In step S173, the likelihood $p(Pi|\mu,\sigma^2)$, (1=<I=<N) derived by the equation (12) is normalized, and the result is regarded as the weight wi at the time of speech unit fusion in the equation (9).

$$w_i = \frac{p(Pi\,|\,\mu,\sigma^2)}{\sum_{j=1}^{N} p(Pi\,|\,\mu,\sigma^2)} \tag{13}$$

Then in step S174, the N speech units are fused together with the above-described unit fusion method, and a fused speech unit is generated. From the data of FIG. 9, the average $\mu$=1647083, and the standard deviation $\sigma$=979927. The likelihood is $p(Pi|\mu,\sigma^2)=1.89*10^{-7}$, $p(Pi|\mu,\sigma^2)=3.52*10^{-7}$, and $p(Pi|\mu,\sigma^2)=1.81*10^{-8}$, and thus the weight is w1=0.34, w2=0.63, and w3=0.03.

As such, the power information of the each of N speech units for the use of unit fusion is weighted more as it comes closer to the range of distribution average that is derived from the power information of the M speech units, and is weighted less as it falls outside the range. Accordingly, in the selected speech units, any speech unit whose power information falls outside the range of average value in the segment can be less weighted, thereby favorably preventing the loss of sound quality even after unit fusion.

Figure 18:
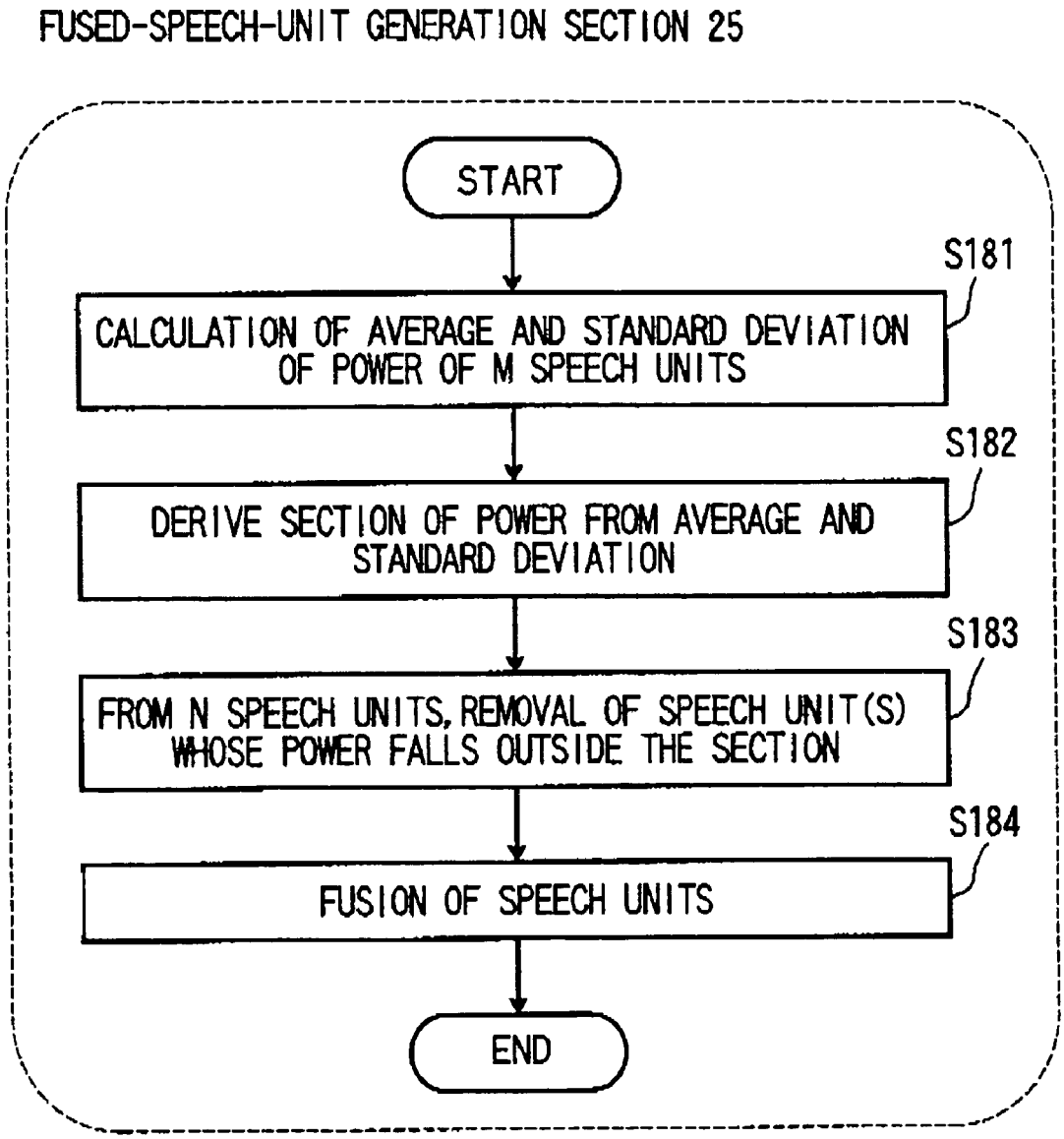
FIG. 18 is another flowchart for illustrating the process operation of the fused speech unit generation section in the second embodiment.
Figure 19:
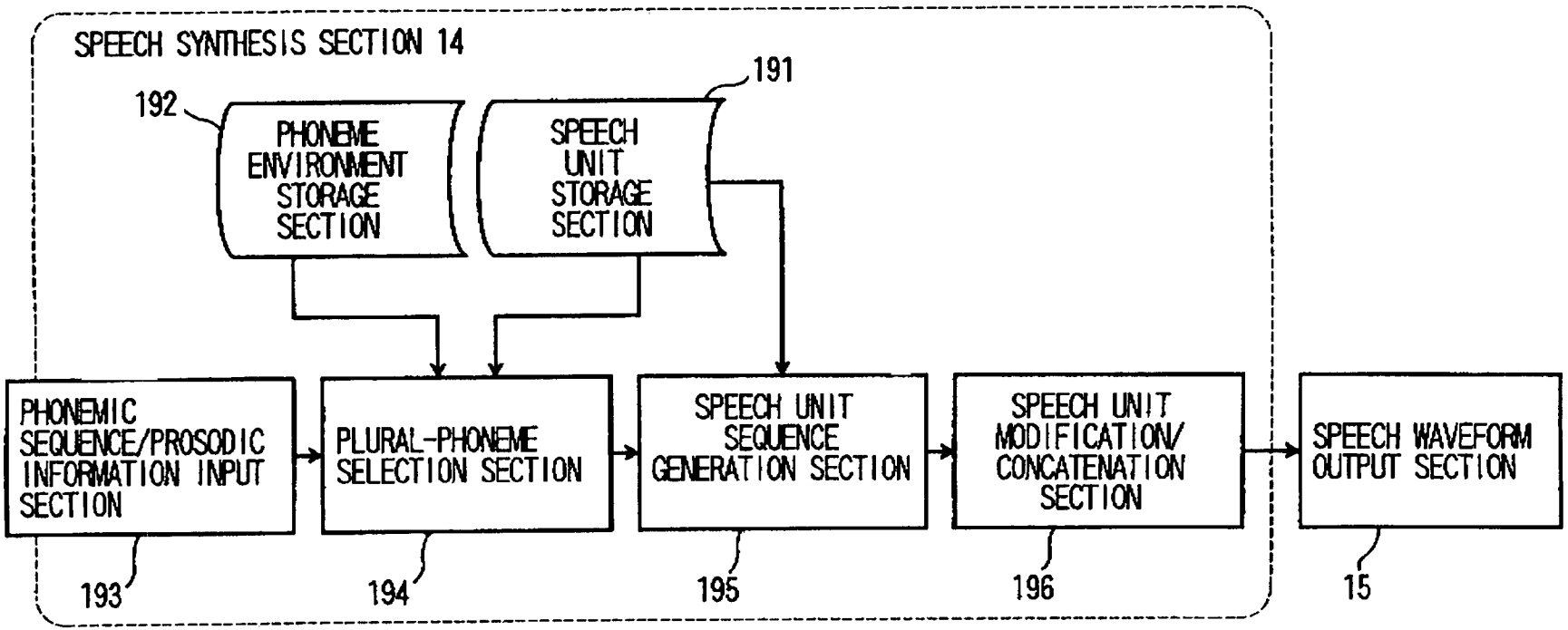
FIG. 19 is a block diagram showing an exemplary configuration of a speech synthesis section in a third embodiment of the present invention.

What is more, as weight approximation for unit fusion, in the distribution of the power information of the M speech units, when any of the N speech units has the power information falling outside the section of a predetermined probability, the weight therefor is set to 0. The remaining speech units are equalized in weight, and fused together. FIG. 18 shows such a process. In step S181, the power information of the selected M speech units is calculated for its average and standard deviation. In step S182, derived is a section in which the power information shows a predetermined probability. For example, with a section of ($\mu-1.96\ \sigma<Pi<\mu+1.96\ \sigma$) the probability for Pi falling in the section is 95%.

In step S183, the speech unit(s) falling outside the section as described above are removed. To remove such a speech unit(s), the weight wi for such a speech unit(s) falling outside the section is set to 0.

In step S184, the remaining speech units are then fused together so that a fused speech unit is derived. With application to the data of FIG. 9, the section is (−273573<Pi<3567739), and P3=4091979 falls outside this section. Accordingly, speech unit fusion may be performed with wi=0.5, w2=0.5, and w3=0 to eliminate any speech unit falling outside the section. The above technique is not the only option for such section determination, and a technique based on interquartile range being a statistic is also a possibility.

For example, through power sorting, a difference between a ¾th power value (upper quartile) and a ¼th power value (lower quartile) is referred to as interquartile range. The value derived by multiplying the interquartile range by constant, e.g., 1.5 times, is subtracted from the power value of lower quartile. The value derived by multiplying the interquartile range by constant is added to the power value of upper quartile. The range between these two values is defined as a section, and any values falling outside this section are regarded as faulty values.

In the present invention, when the power information of the N-best speech units selected for a specific segment falls outside such a section, the weight assigned to the speech units are reduced for unit fusion, or the speech units are removed before unit fusion. As a result, favorably derived is a synthesized speech sounding natural with no loss of sound quality, that is often caused by fusing speech units varying in power information. In fusion of the first embodiment, the weight for speech unit fusion may be determined in the manner of the second embodiment, and the power information may be corrected in the manner of the first embodiment.

Third Embodiment

In a third embodiment, with the speech unit synthesis method of selecting a speech unit, the power information of an optimally-selected speech unit is corrected to be equalized with the average power information of a plurality of speech units. Compared with the first and second embodiments, the difference lies in that no speech unit fusion is executed in process.

1. Configuration of Speech Synthesis Section 14

FIG. 18 is a diagram showing an exemplary configuration of the speech synthesis section 14 of the third embodiment.

The speech synthesis section 14 is configured to include a speech unit storage section 191, a speech unit environment storage section 192, a phonetic sequence/prosodic information input section 193, a plural-speech unit selection 194, a speech unit generation section 195, a speech unit modification/concatenation section 195, and a speech waveform output section 15.

1. Speech Unit Storage Section 191

Similarly to the first embodiment, the speech unit storage section 191 stores speech units as a result of database analysis, and the phonetic environment storage section 192 stores the phonetic environment for each of the speech units.

2. Plural-Speech-Unit Selection Section 193

Figure 20:
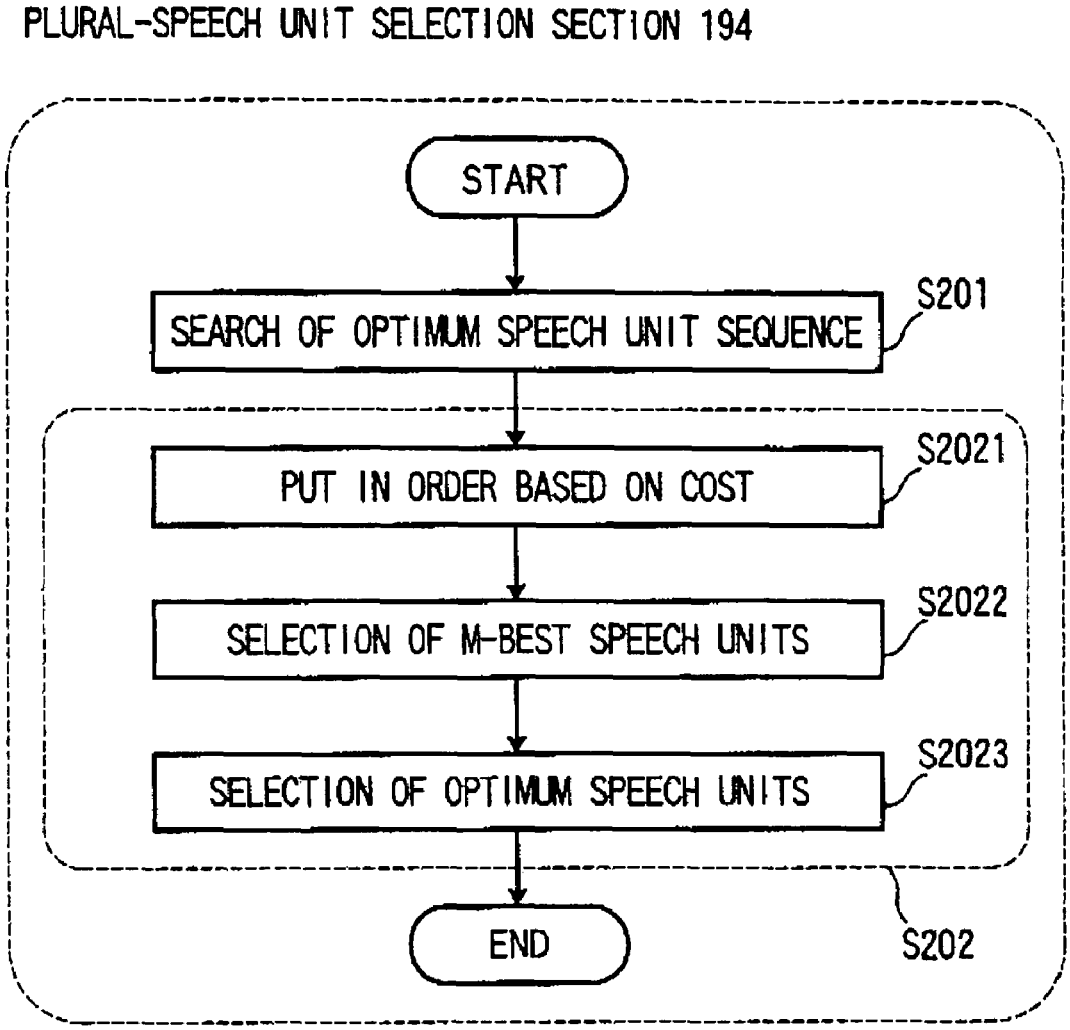
FIG. 20 is a flowchart for illustrating the process operation of a plural speech units selection section in the third embodiment.

With respect to each of the synthesis unit of the input phonetic sequence, the plural-speech-unit selection section 193 estimates the level of distortion of the prosodic information in the phonetic environment of the speech units compared with the input prosodic information. In such a manner as to minimize the distortion level, the plural-speech-unit selection section 193 selects a plurality of speech units and an optimum speech unit from those stored in the speech unit storage section 191. As shown in FIG. 20, the selection of a plurality of speech units can be made based on the above-described cost function. Compared with the processes of FIG. 6, the difference lies in that only an optimum speech unit is selected instead of the N-best speech units. As a result, selected are M speech units (M>0) corresponding to the respective segments in the phonetic symbol sequence being the input phonetic sequence, and an optimum speech unit.

3. Speech Unit Generation Section 195

Described next is the speech unit generation section 195.

In the speech unit generation section 195, the power information of the optimum speech unit selected by the plural-speech-unit selection section 194 is corrected so that a speech unit is generated for the use of speech synthesis.

Figure 21:
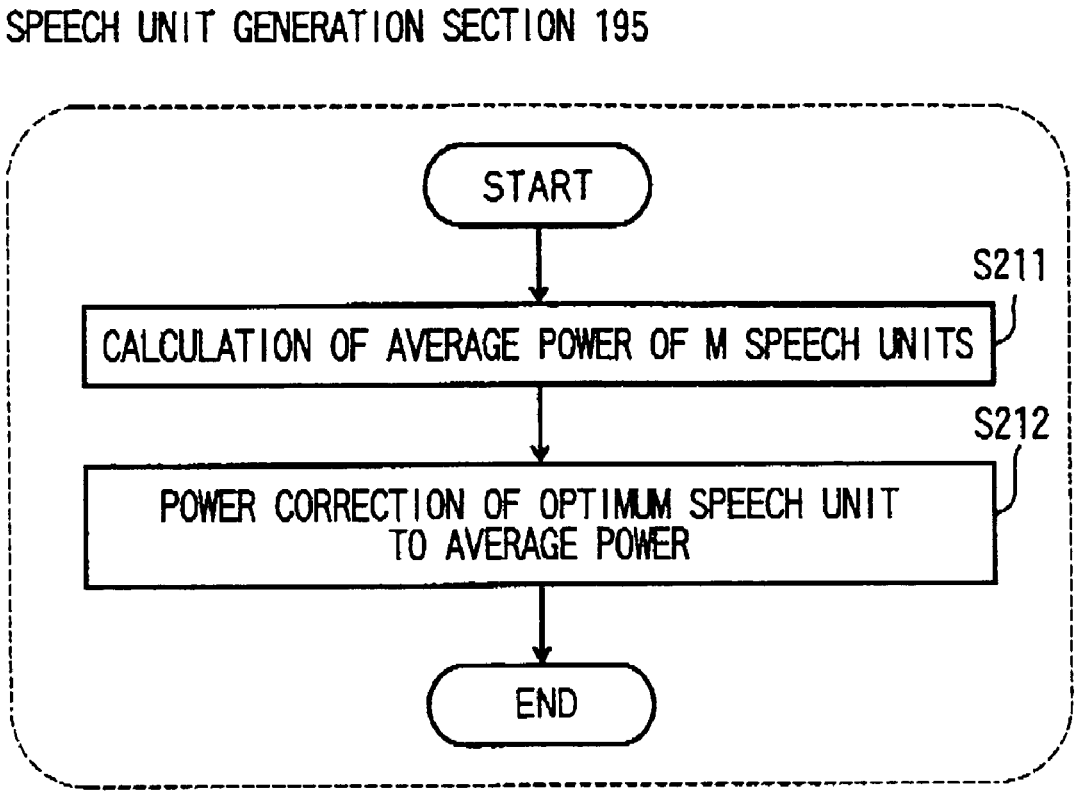
FIG. 21 is a flowchart for illustrating the process of a fused speech unit generation section in the third embodiment.

FIG. 21 shows the processes to be executed by the speech unit generation section 195.

First of all, in step S211, the power information Pi is calculated for each of the selected M speech units (1=<i=<M), and then the average power information Pave is calculated. Similarly to the first embodiment, the equations (6) and (7) are to be used for such calculations. In step S212, the power information P1 of the optimum speech unit is corrected to be equalized with the average power information Pave calculated in step S211 for the M speech units. In this example, the ratio r for power information correction is calculated by the following equation (14):

$$r = \sqrt{\frac{P_{ave}}{P_1}} \tag{14}$$

By multiplying this ratio r to the optimum speech unit, the power information is accordingly corrected.

In the data of FIG. 9, the average power information Pave of the M speech units is 1647084, the power information P1 of the optimum speech unit is 2859883, and the ratio r is 0.76. By multiplying this ratio r to the speech waveform of the optimum speech unit, the power information is corrected.

4. Speech Unit Modification/Concatenation 196

In the speech unit modification/concatenation 196, the speech waveform is generated for a synthesis speech by modifying and concatenating the speech unit in accordance with the input prosodic information. Specifically, a speech waveform can be generated by concatenating a pitch-cycle waveform extracted from a speech unit in such a manner that the speech unit has the same fundamental frequency and the phonetic duration as those of a target speech in the input Prosodic information.

As described in the foregoing, in the present embodiment, with the speech synthesis method of selecting a speech unit, any selected speech units are corrected to have the average power information of the M speech units. In this manner, successfully derived is a synthesized speech that is stable in power with good sound quality.

5. Modified Example

Similarly to the second embodiment, the power information of the M speech units may be used to derive a section, and in thus derived section, an optimum speech unit may be selected.

Figure 22:
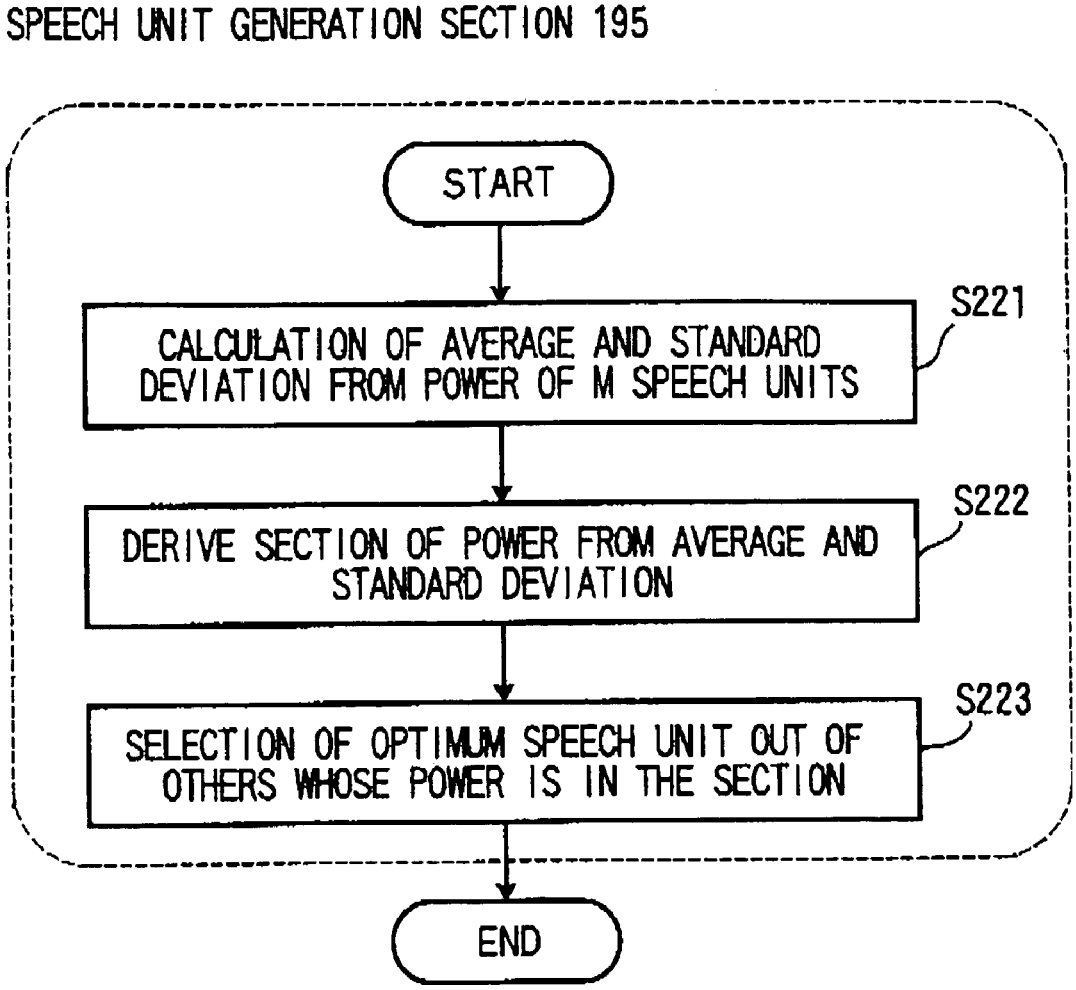
FIG. 22 is another flowchart for illustrating the process of the fused speech unit generation section in the third embodiment.

With this being the case, the speech unit generation section 195 goes through such processes as shown in FIG. 22.

In step S221, the power information of the M speech units is calculated for its average and standard deviation. In step S222, derived is a section in which the power information has a predetermined probability.

In step S223, if the power information P1 of the 1st-place speech unit is in the section, the speech unit is put in use. If no such power information is found in the section, a determination is then made whether or not the section carries the power information P2 of the 2nd-place speech unit. Such a process is repeated until finding a speech unit showing the minimum cost out of those others whose power information is fitting in the section. In this manner, when any higher-order speech units have each varying power information, the corresponding speech units are removed as considered outlier. Therefore, from the remaining not-outlier speech units, an optimum speech unit can be selected. Alternatively, the power information of the optimum speech unit selected as such may be corrected to be equalized with the average power information of the M speech units.

The speech unit selected as such is modified and concatenated in the speech unit modification/concatenation section 196 so that a synthesis speech can be derived.

Similarly to the first embodiment, the mean absolute amplitude value may be used as an alternative to the average power information.

Similarly also to the first embodiment, the power information is corrected only to put it on a downward path. Therefore, in step S212 of FIG. 21 of correcting the power information of an optimum speech unit, the power information may be corrected only when the correction ratio r is smaller than 1.0. This can prevent any noise components from being amplified in the optimum speech unit.

What is claimed is:

1. A speech synthesis system for generating synthesized speech by segmenting a phonetic sequence derived from an input text by predetermined synthesis units, and by concatenation of representative speech units each of which is extracted from respective one of the synthesis units, the system comprising:

a storage unit configured to store a plurality of speech units corresponding to the synthesis units;

a selector configured to select, with respect to each of the synthesis units of the phonetic sequence derived from the input text, N speech units and M speech units (N<M) in an order corresponding to a smaller cost calculated by a cost function, respectively, from those speech units stored in the storage unit, based on a result of the cost function indicating a level of distortion of the synthesized speech;

a representative speech generator configured to generate the representative speech unit corresponding to the synthesis unit by calculating a statistics of power information from the M selected speech units, and by fusing the N speech units so as to increase the synthesized speech in quality by carrying out at least one of correction of the power information based on the statistics of the power information, weight assignment based on the power information, and removal of the speech unit based on the power information; and a speech waveform generator configured to generate a speech waveform by concatenating the generated representative speech units, the cost function being a function represented by a weighted sum of plural sub-cost functions, and each of the sub-cost functions being one for calculating the cost needed to estimate a level of distortion with respect to a target speech of the synthesized speech that occurs when the synthesized speech is generated by using the speech units stored in the storage unit.

2. The speech synthesis system according to claim 1, wherein the representative speech generator:

calculates an average value of power information from the selected M speech units, generates a fused speech unit by fusing the N selected speech units, and generates the representative speech unit by correcting power information of the fused speech unit to be equalized with the average value of the power information calculated from the M speech units.

3. The speech synthesis system according to claim 2, wherein only when the power information of the fused speech unit derived by fusing the N speech units is larger than the average value of the power information calculated from the M speech units, the fused speech unit is corrected to equalize the power information of the fused speech unit with the average value of the power information.

4. The speech synthesis system according to claim 1, wherein the representative speech generator:

calculates an average value of power information from the selected M speech units, corrects power information for each of the selected N speech units to be equalized with the average value of the power information, and generates the representative speech unit by fusing the corrected N speech units.

5. The speech synthesis system according to claim 3, wherein only when the power information of each of the N speech unit is larger than the average value of the power information calculated from the M speech units, the speech units are corrected to equalize the power information of each of the N speech units with the average value of the power information.

6. The speech synthesis system according to claim 1, wherein the representative speech generator:

calculates an average value of power information of the selected M speech units, calculates an average value of power information of the selected N speech units, calculates a correction value for correcting the average value of the power information of the N speech units to the average value of the power information of the M speech units, corrects each of the N speech units by applying the correction value, and generates the representative speech unit by fusing the corrected N speech units.

7. The speech synthesis system according to claim 4, wherein only when the average value of the N speech unit is larger than the average value of the power information of the M speech units, a correction value is calculated to make a correction to equalize the average value of the power information of the N speech units with the power information of the M speech units, and the correction value is applied to the N speech units.

8. The speech synthesis system according to claim 1, wherein the representative speech generator:

calculates a statistics of power information from the selected M speech units, calculates power information for each of the selected N speech units, determines a weight for each of the N speech units based on the calculated statistics of the power information, and the power information of the N speech units, and generates the representative speech unit by fusing the N speech units based on the weight.

9. The speech synthesis system according to claim 1, wherein the power information is a mean square value or a mean absolute amplitude value of the speech waveform.

10. The speech synthesis system according to claim 1, wherein only when the power information of the selected optimum speech unit is larger than the average value of the power information calculated from the M speech units, the power information of the optimum speech unit is corrected.

11. A speech synthesis system for generating synthesized speech by segmenting a phonetic sequence derived from an input text by predetermined synthesis units, and by concatenation of representative speech units each of which is extracted from respective one of the synthesis units, the system comprising:

a storage unit configured to store a plurality of speech units corresponding to the synthesis units;

a selector configured to select, with respect to each of the synthesis units of the phonetic sequence derived from the input text, N speech units and M speech units (N<M) in an order corresponding to a smaller cost calculated by a cost function, respectively, from those speech units stored in the storage unit based on a result of the cost function indicating a level of distortion of the synthesized speech;

a representative speech generator configured to generate the representative speech unit from the M and N speech units; and a speech waveform generator configured to generate a speech waveform by concatenating the generated representative speech units, wherein the representative speech generator:

calculates a range of a power information value, in which a distribution of the power information is greater than or equal to a predetermined probability, or the power information is appropriate, from a statistics of power information of the selected M speech units, calculates power information for each of the selected N speech units, removes the speech unit so as not to be selected, when the power information of the N speech units is beyond the range, and generates the representative speech unit by fusing the removed speech unit, the cost function being a function represented by a weighted sum of plural sub-cost functions, and each of the sub-cost functions being one for calculating the cost needed to estimate a level of distortion with respect to a target speech of the synthesized speech that occurs when the synthesized speech is generated by using the speech units stored in the storage unit.

12. A speech synthesis method for generating a synthesized speech by segmenting a phonetic sequence derived from an input text by predetermined synthesis units, and by concatenating representative speech units each of which is extracted from respective one of the synthesis units, the method comprising:

storing a plurality of speech units corresponding to the synthesis unit in a storage unit;

selecting, with respect to each of the synthesis units of the phonetic sequence derived from the input text, N speech units and M speech units, (N<M) in an order corresponding to a smaller cost calculated by a cost function, respectively, from those stored in the storage unit based on a result of the cost function indicating a level of distortion of the synthesized speech;

generating the representative speech unit corresponding to the synthesis unit by calculating a statistics of power information from the M selected speech units, and by fusing the N speech units so as to increase the synthesized speech in quality by carrying out at least one of correction of the power information based on the statistics of the power information, weight assignment based on the power information, and removal of the speech unit based on the power information; and generating a speech waveform by concatenation the generated representative speech unit, the cost function being a function represented by a weighted sum of plural sub-cost functions, and each of the sub-cost functions being one for calculating the cost needed to estimate a level of distortion with respect to a target speech of the synthesized speech that occurs when the synthesized speech is generated by using the speech units stored in the storage unit.

13. A speech synthesis method for generating a synthesized speech by segmenting a phonetic sequence derived from an input text by predetermined synthesis units, and by concatenating representative speech units each of which is extracted from respective one of the synthesis units, the method comprising:

storing a plurality of speech units corresponding to the synthesis unit in a storage unit;

selecting, with respect to each of the synthesis units of the phonetic sequence derived from the input text, N speech units and M speech units (N<M) in an order corresponding to a smaller cost calculated by a cost function, respectively, from those speech units stored in the storage unit based on a result of the cost function indicating a level of distortion of the synthesized speech;

generating the representative speech unit corresponding to the synthesis unit from the N speech units and the M speech units; and generating a speech waveform by concatenating the generated representative speech units, wherein the generating the representative speech includes:

calculating a section indicating a range of a power information value in which a distribution of the power information is of a predetermined probability or more, or a section in which the power information is appropriate, calculating power information for each of the selected N speech units, respectively, removing the speech unit to be selected, when the power information of any of the N speech units is not fitting in the section, and generating the representative speech unit by fusing the removed speech unit, and the cost function is a function represented by a weighted sum of plural sub-cost functions, and each of the sub-cost functions is one for calculating the cost needed to estimate a level of distortion with respect to a target speech of the synthesized speech that occurs when the synthesized speech is generated by using the speech units stored in the storage unit.

* * * * *